US008261678B2

(12) United States Patent
Nakashima et al.

(10) Patent No.: US 8,261,678 B2
(45) Date of Patent: Sep. 11, 2012

(54) WORKPIECE PROCESSING ATTACHMENT AND SEWING MACHINE

(75) Inventors: Akifumi Nakashima, Ichinomiya (JP); Daisuke Ueda, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 318 days.

(21) Appl. No.: 12/656,237

(22) Filed: Jan. 21, 2010

(65) Prior Publication Data

US 2010/0212562 A1 Aug. 26, 2010

(30) Foreign Application Priority Data

Feb. 23, 2009 (JP) ..... 2009-039308

(51) Int. Cl.
*D05B 23/00* (2006.01)

(52) U.S. Cl. ..... 112/2

(58) Field of Classification Search ..... 112/2, 240, 112/274, 277, 281, 221, 235, 244, 245, 246
See application file for complete search history.

(56) References Cited

U.S. PATENT DOCUMENTS

| | | | | |
|---|---|---|---|---|
| 5,097,778 | A * | 3/1992 | Niino | 112/311 |
| 5,284,104 | A * | 2/1994 | Hori et al. | 112/102.5 |
| 5,653,185 | A * | 8/1997 | Badillo | 112/240 |
| 7,966,955 | B2 * | 6/2011 | Niizeki | 112/89 |

FOREIGN PATENT DOCUMENTS

| | | |
|---|---|---|
| JP | A-1-320195 | 12/1989 |
| JP | U-3105746 | 11/2004 |

* cited by examiner

*Primary Examiner* — Tejash Patel
(74) *Attorney, Agent, or Firm* — Oliff & Berridge, PLC

(57) ABSTRACT

A workpiece processing attachment detachably attached to a sewing machine including a presser foot, a presser bar having the presser foot detachably attached to its lower end, a presser bar vertically moving mechanism, a sewing needle, a needle clamp having the sewing needle detachably attached thereto, a needle bar having the needle clamp attached thereto, and a needle bar vertically moving mechanism, the workpiece processing attachment, including a body detachably attached to the lower end of the presser bar; a connecting element capable of being connected to the needle clamp and movable up and down with the needle bar being moved up and down by the needle bar vertically moving mechanism; a needle penetrating the workpiece to form a hole in the workpiece; and a needle vertically moving mechanism moving the needle up and down by the up and down movement of the connecting element.

6 Claims, 17 Drawing Sheets

130

| 133 M | 134 X | 135 Y | 136 DEPTH |
|---|---|---|---|
| 0 | 0.000 | 0.000 | 3 |
| 0 | + 1.000 | 0.000 | 5 |
| 0 | + 0.500 | + 0.866 | 3 |
| 0 | − 0.500 | + 0.866 | 3 |
| 0 | − 1.000 | 0.000 | 4 |
| 0 | − 0.500 | − 0.866 | 5 |
| 0 | + 0.005 | − 0.866 | 2 |
| 0 | +11.000 | 0.000 | 1 |
| 0 | +10.005 | + 0.866 | 1 |
| | | | |
| | | | |
| 1 | + 5.000 | 0.000 | 0 |
| 1 | + 3.536 | + 3.536 | 0 |
| 1 | 0.000 | + 5.000 | 0 |
| 1 | − 3.536 | + 3.536 | 0 |
| | | | |

131

132

FIG. 9

WORKPIECE PROCESSING ATTACHMENT AND SEWING MACHINE

CROSS-REFERENCE TO RELATED APPLICATIONS

This application is based upon and claims the benefit of priority from the prior Japanese Patent Application 2009-039308, filed on Feb. 23, 2009, the entire contents of which are incorporated herein by reference.

FIELD

The present disclosure relates to a workpiece processing attachment attached to a sewing machine for forming embosses and holes on a workpiece and a sewing machine provided with such workpiece processing attachment.

BACKGROUND

One of popular techniques in creating ornaments is pattern formation on a workpiece such as paper and cloth, for instance, by way of embosses and holes. Examples of such techniques are embossing the workpiece with dot impact devices or manually embossing cardboards using emboss templates that outline various patterns.

Resent trend in paper art is parchment crafting in which ornaments are created by forming embosses and holes on workpiece such as a thick tracing paper.

The problem with the dot impact device mentioned earlier is that it is not fit for general use in commercial art and personal hobbies such as arts and crafts because it is oversized and limited in application. The emboss template, on the other hand, requires dedicated templates for each type of pattern and thus the number of templates increases with the number of patterns. Moreover, because the patterns are formed by hand, the work involves complexity and is time consuming.

SUMMARY

An object of the present disclosure is to provide a workpiece processing attachment suitable for use in parchment crafting and that facilitates formation of complex patterns made of multiplicity of embosses and holes by employing mechanisms and devices that are provided on conventional sewing machines. Another object of the present disclosure is to provide a sewing machine being provided with such workpiece processing attachment.

In one aspect of the present disclosure a workpiece processing attachment is provided that processes a workpiece and that is detachably attached to a sewing machine including a presser foot that presses the workpiece, a presser bar that has the presser foot detachably attached to a lower end thereof, a presser bar vertically moving mechanism that moves the presser bar up and down, a sewing needle that penetrates the workpiece, a needle clamp that has the sewing needle detachably attached thereto, a needle bar that has the needle clamp attached to its lower end, and a needle bar vertically moving mechanism that moves the needle bar up and down, the workpiece processing attachment, including a body that is detachably attached to the lower end of the presser bar; a connecting element that is capable of being connected to the needle clamp and that is movable up and down with the needle bar being moved up and down by the needle bar vertically moving mechanism; a needle that penetrates the workpiece to form a holes in the workpiece; and a needle vertically moving mechanism that moves the needle up and down by the up and down movement of the connecting element.

BRIEF DESCRIPTION OF THE DRAWINGS

Other objects, features and advantages of the present disclosure will become clear upon reviewing the following description of the illustrative aspects with reference to the accompanying drawings, in which.

FIG. 9 schematically indicates a data structure of pattern data;

DETAILED DESCRIPTION

With reference to the drawings, a description will be given hereinafter on multiple exemplary embodiments of a workpiece processing attachment or simply, "attachment" applied to a sewing machine. The following description will be based upon an assumption that the directions represented in FIG. 1, indicate the front and rear, left and right, and up and down of the sewing machine, which are hereinafter also represented as the X direction, Y direction, and Z direction respectively. The sewing machine according to a first exemplary embodiment is not only capable of sewing a workpiece cloth as it is normally used, but is also capable of parchment crafting. The workpiece commonly used in parchment crafting are materials such as tracing papers and cardboards. The first exemplary embodiment is based on, but not limited to, a household sewing machine provided with a needle bar vertically moving mechanism that moves a presser bar up and down.

Figure 1:
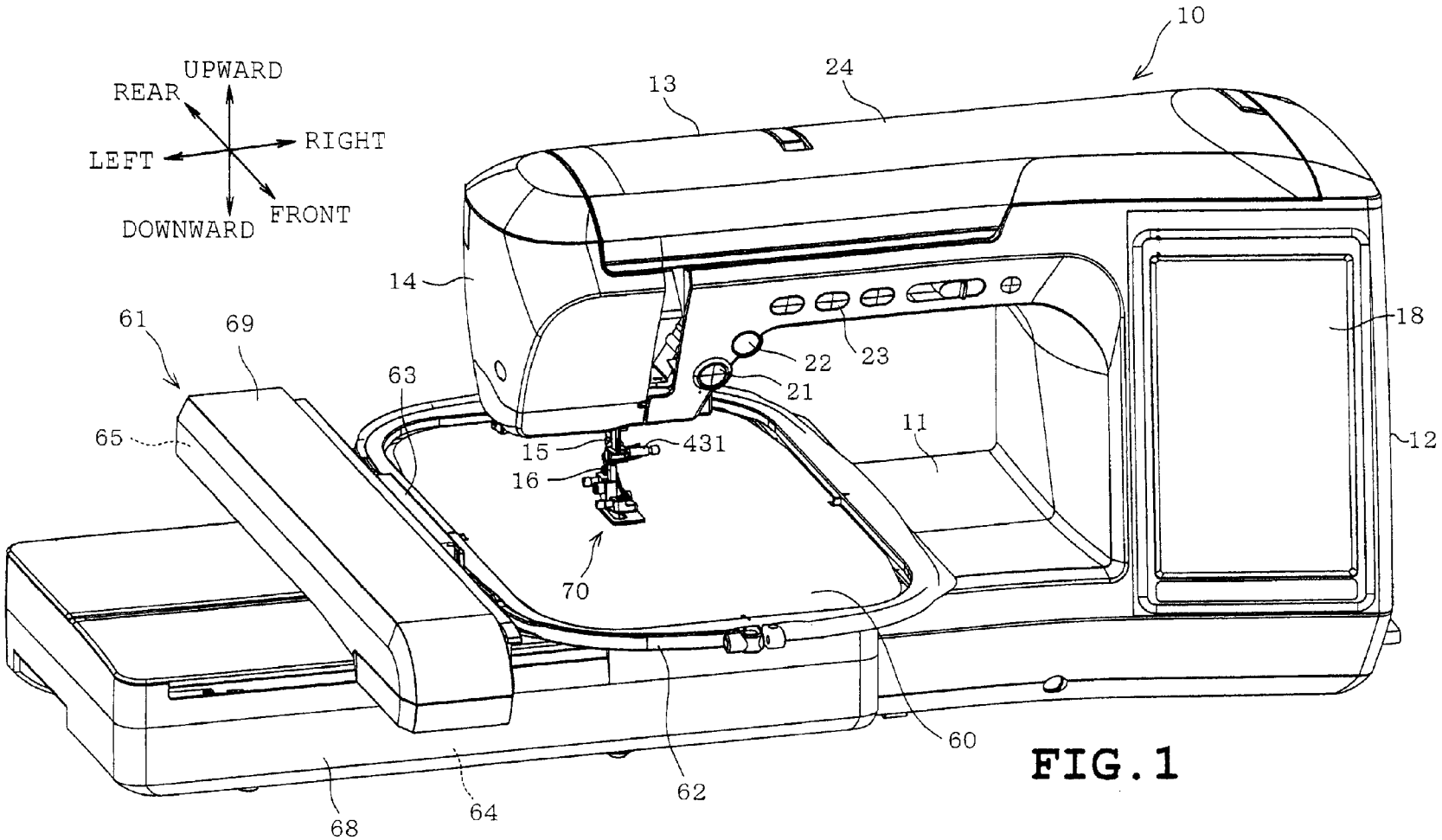
FIG. 1 is a perspective view of a sewing machine being attached with a workpiece processing attachment according to a first exemplary embodiment of the present disclosure.
Figure 2:
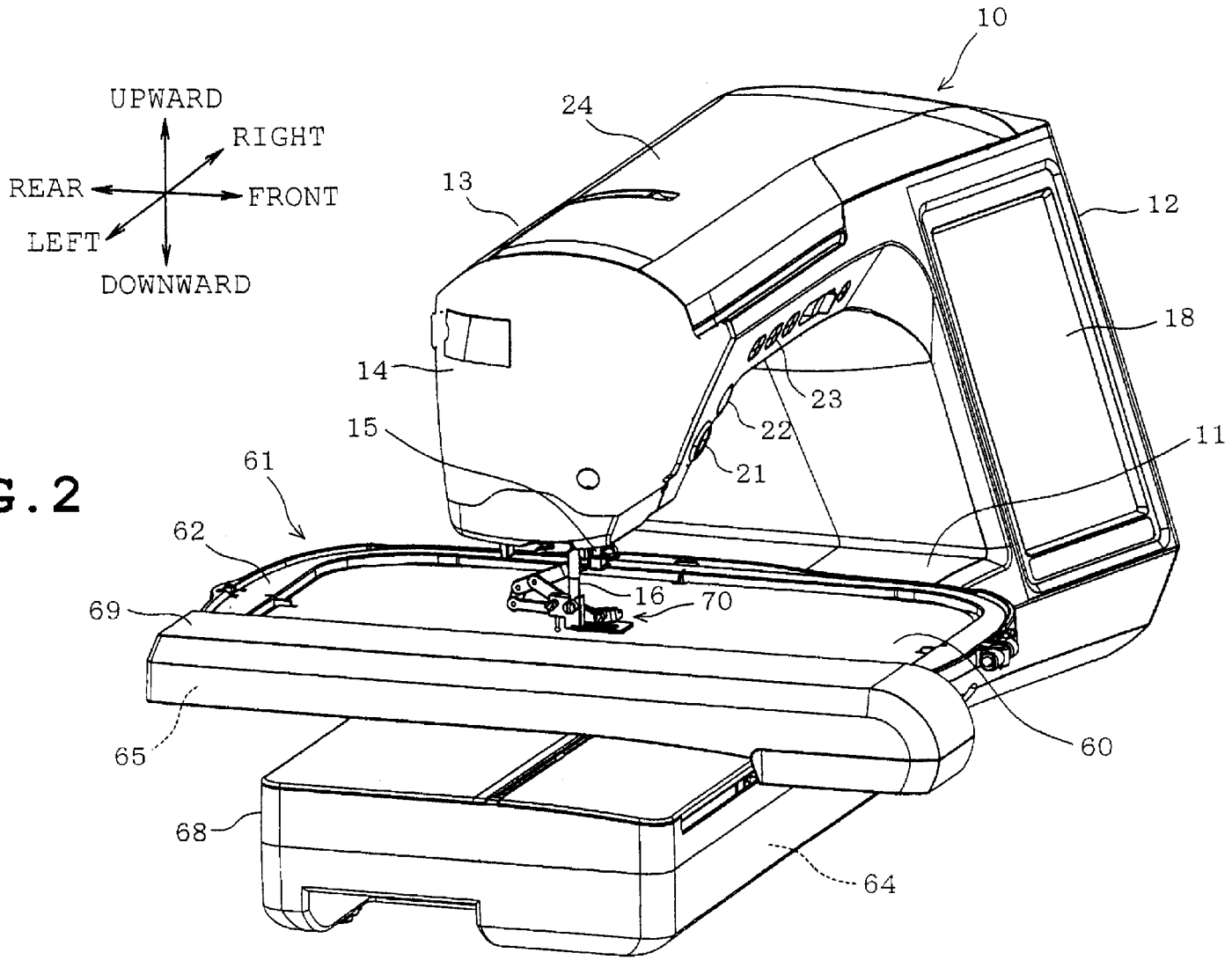
FIG. 2 is a perspective view of the sewing machine according to the first exemplary embodiment as viewed from the left side.

Referring to FIGS. 1 and 2, sewing machine 10 according to the first exemplary embodiment includes bed 11, pillar 12, arm 13, head 14, needle bar 15, and presser bar 16. Pillar 12 extends upward from the right end of the bed 11. From the upper end of pillar 12, arm 13 extends leftward over bed 11 and the left end extreme of arm 13 defines head 14. Bed 11 is provided with needle plate 17 which is coplanar with the upper surface of bed 11. Within bed 11 below needle plate 17 are components such as a shuttle mechanism and feed mechanism not shown. Shuttle mechanism has a bobbin not shown detachably attached to it which is wound with a bobbin thread. The feed mechanism drives a feed dog not shown for transferring a workpiece cloth not shown. As shown in FIGS. 1 and 2, pillar 12 has LCD 18 on its front face whereas on the lower front face of arm 13, various switches such as sewing start switch 21, sewing end switch 22 and presser foot vertically moving switch 23 are provided.

On the upper side of arm 13, openable/closable cover 24 is provided which extends in the left and right direction along the entire length of arm 13. Cover 24 is pivoted about a rotary shaft not shown that is provided on the upper rear end side of arm 13 so that it may open/close the upper portion of arm 13. Within arm 13 below cover 24, a thread storage not shown which stores a thread spool also not shown is wound with needle thread.

Figure 4:
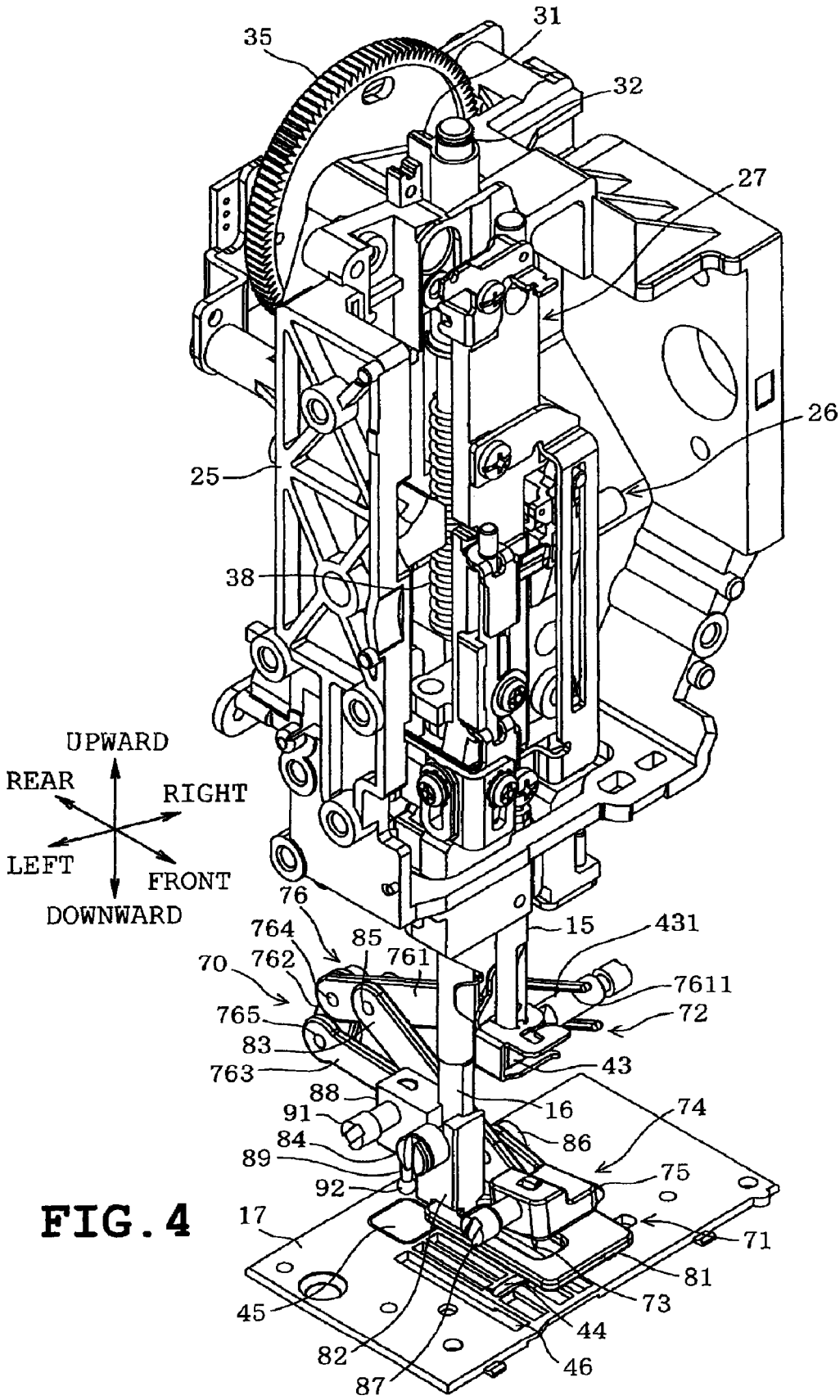
FIG. 4 is a perspective view indicating a needle bar vertically moving mechanism and a presser bar vertically moving mechanism provided within a head of the sewing machine according to the first exemplary embodiment.

Needle bar 15 is provided in head 14 and as shown in FIG. 4, is supported reciprocably up and down by sewing machine frame 25 which constitutes head 14. Needle bar 15 is reciprocated up and down by needle bar vertically moving mechanism 26. Needle bar vertically moving mechanism 26 is driven by the drive force of sewing machine motor 30 shown in FIG. 5 by way of sewing machine drive mechanism not shown which is provided with components such as a main shaft not shown. The configuration of sewing machine drive mechanism which is well known in the art will not be described.

Figure 3:
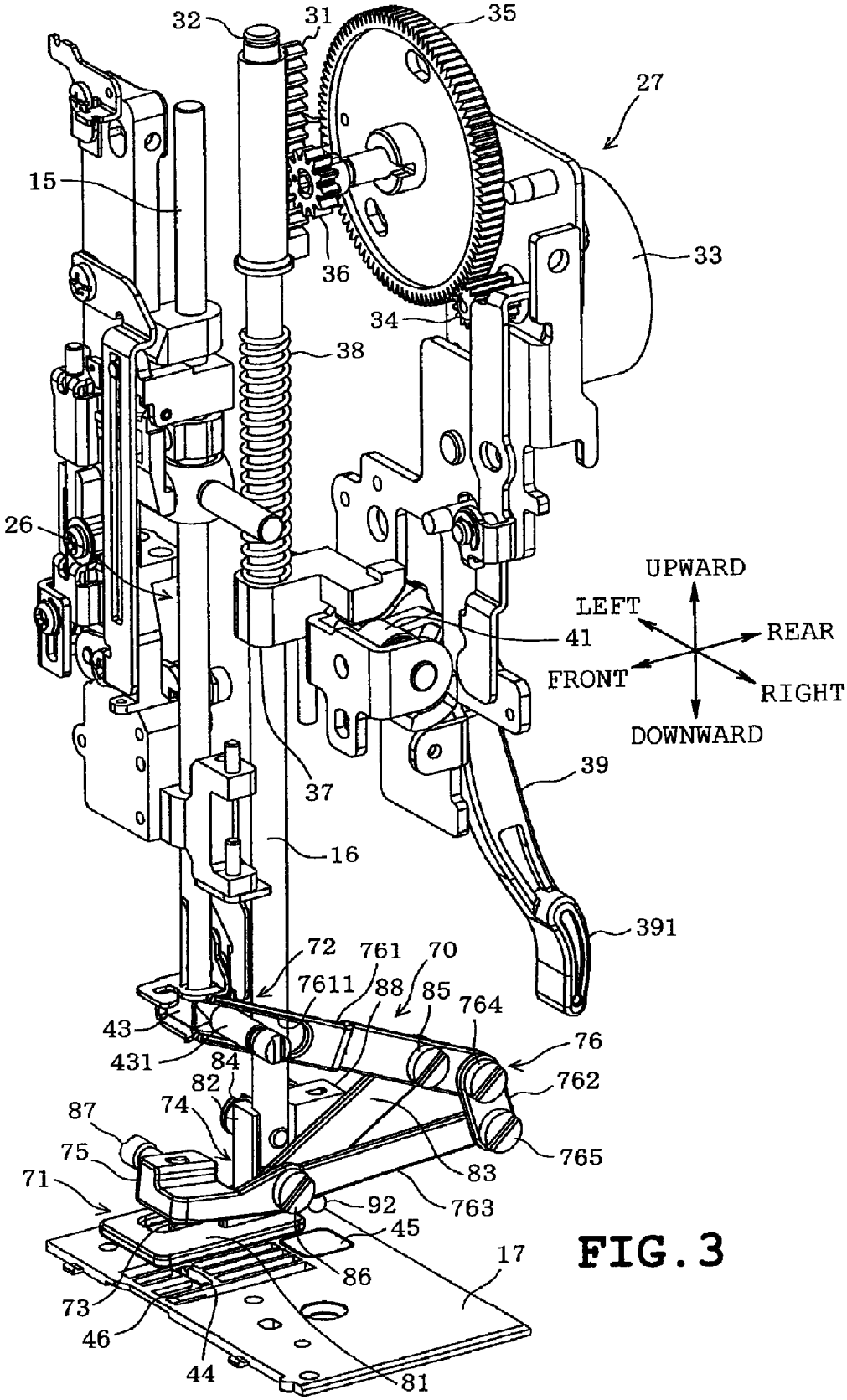
FIG. 3 is a perspective view indicating a needle bar vertically moving mechanism and a presser bar vertically moving mechanism provided within a head of the sewing machine according to the first exemplary embodiment.

As shown in FIGS. 3 and 4, sewing machine 10 is provided with presser bar vertically moving mechanism 27 that drives presser bar 16 up and down. Presser bar vertically moving mechanism 27 is disposed behind needle bar 15 and includes components such as rack 31, stop ring 32, pulse motor 33, drive gear 34, intermediate gear 35, pinion gear 36, presser bar clamp 37, press spring 38, presser foot lifting lever 39, and potentiometer 41. Rack 31 is mounted on the upper portion of presser bar 16 so as to be movable up and down and stop ring 32 is secured on the upper end of presser bar 16. Pulse motor 33 generates the drive force for driving needle bar 16 up and down and is secured by sewing machine frame 25 at the immediate right side of rack 31. Drive gear 34 is mounted on the output shaft of pulse motor 33. Intermediate gear 35 is in mesh with drive gear 34. Pinion gear 36 is formed integrally with intermediate gear 35 and is in mesh with rack 31. Presser bar clamp 37 is secured on a vertical mid portion of presser bar 16. Press spring 38 is mounted on a portion of presser bar 16 between rack 31 and presser bar 37. Presser foot lifting lever 39 is manually operated to vertically move presser bar 16 independent of the vertical movement of presser bar 16 by pulse motor 33. Potentiometer 41 is provided on the left side of presser bar 16 and detects the vertical position of presser bar clamp 37, in other words, the vertical position of presser bar 16.

Potentiometer 41 comprises a rotary potentiometer and has a lever not shown that extends rightward from a rotary shaft of potentiometer 41 that is placed in consistent contact with an upper surface of a protrusion protruding leftward from presser bar clamp 37. Thus, when presser bar clamp 37 is elevated by the elevation of the presser bar 16, the lever is swung to alter the resistance of potentiometer 41. The position of presser bar 16 is detected based on a voltage outputted depending upon the variation of the resistance.

One end of presser foot lifting lever 39 is pivoted about a pin not shown secured on sewing machine frame 25. On the other end of presser foot lifting lever 39, handle 391 is provided to allow manual operation by the user. By manually operating handle 391, presser foot lifting lever 39 can be moved from the lowered position to the elevated position. By swinging presser foot lifting lever 39, presser bar 16 can be moved up and down without being driven by the drive fore of pulse motor 33. At the lower end of presser bar 16, a presser foot not shown may be detachably attached. When executing a sewing operation with sewing machine 10, the presser foot is attached to the lower end of presser bar 16. Needle bar 15 allows detachable attachment of a sewing needle at its lower end. More specifically, sewing needle is attached to needle clamp 43 provided at the lower end of needle bar 15. When executing a sewing operation with sewing machine 10, the sewing needle is attached to the lower end of needle bar 15.

Needle plate 17 is provided on the upper surface of bed 11 at a position opposing the lower ends of needle bar 15 and presser bar 16. Needle plate 17 has needle hole 44 and receiving section 45. Needle hole 44 is formed on the line of extension from needle bar 15, that is, on the line of extension of a sewing needle not shown attached to needle bar 15. Thus, as needle bar 15 is lowered, the sewing needle enters needle hole 44 and exits needle hole 44 as needle bar 15 is elevated. Receiving section 45 is located behind squares holes 46 from which a feed dog not shown protrudes and retracts. Receiving section 45 has a buffer element made of elastic material such as rubber. When parchment crafting, the feed dog is maintained at a position so as not to protrude from the upper surface of needle plate 17 by a feed dog vertically moving mechanism not shown.

Figure 5:
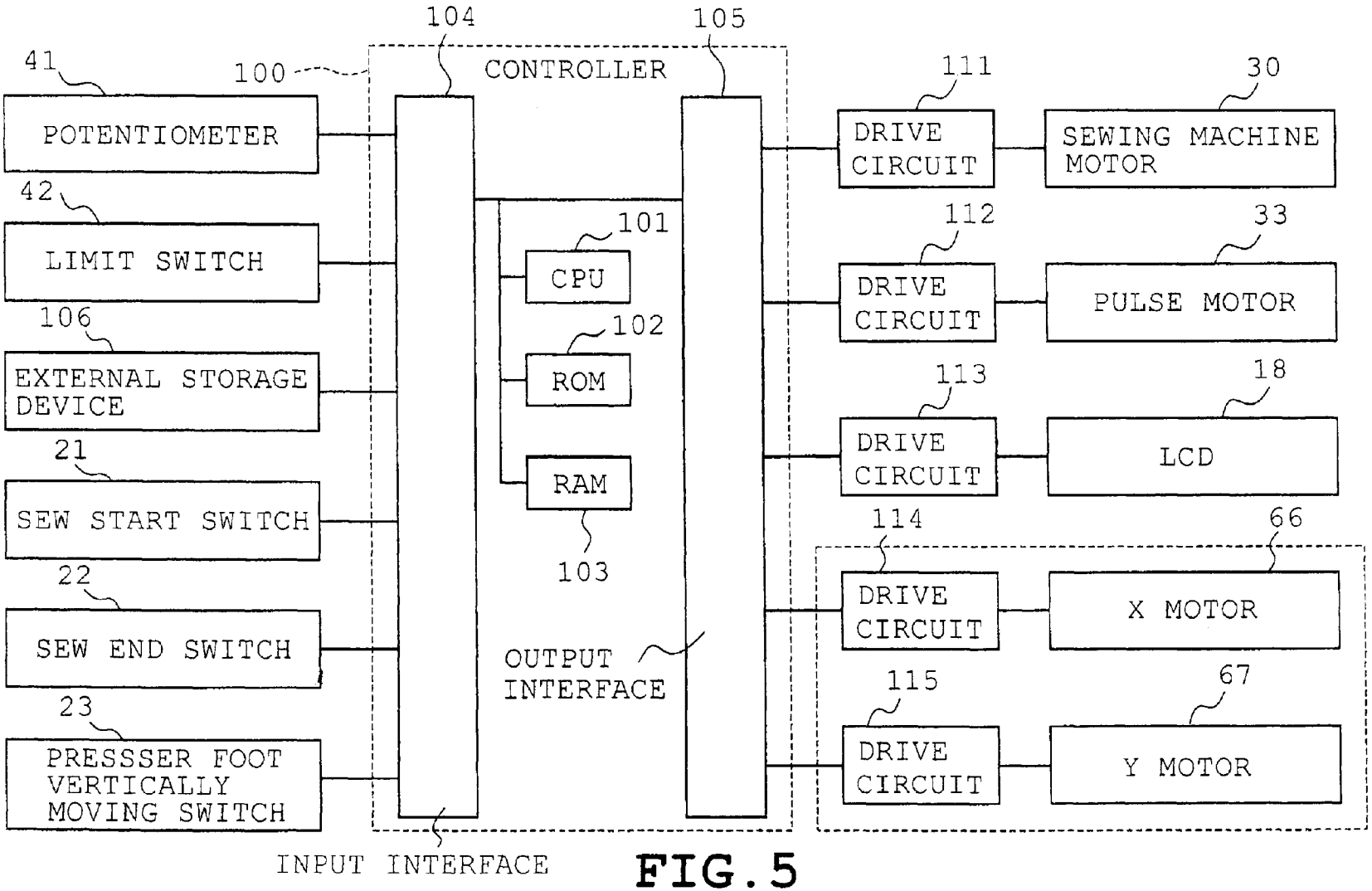
FIG. 5 is a block diagram indicating an electrical configuration of the sewing machine according to the first exemplary embodiment.

As shown in FIGS. 1 and 2, sewing machine 10 is provided with a transfer device 61 that transfers workpiece 60 in the X and Y directions. Transfer device 61 is provided with frame 62, carriage 63, X-direction transfer mechanism 64, and Y-direction transfer mechanism 65. X-direction transfer mechanism 64 is contained in casing 68 of transfer device 61 detachably attached to bed 11. Y-direction transfer mechanism 65 is located immediately above casing 68 and is contained in cover 69. Frame 62 supports workpiece 60 such as a tracing paper, and frame 62 is in turn supported by carriage 63. Y-direction transfer mechanism 65 transfers carriage 63 in the front and the rear direction represented as the Y-direction. X-direction transfer mechanism 64 is provided below Y-direction transfer mechanism 65 and transfers carriage 63 as well as Y-direction transfer mechanism 64 in the left and right direction represented as the X-direction. As shown in FIG. 5, X-direction transfer mechanism 64 is provided with X motor 66 that drives Y-direction transfer mechanism 65 in the X direction. Similarly, as shown in FIG. 5, Y-direction transfer mechanism 65 is provided with Y motor 67 that drives carriage 63 in the Y direction. X motor 66 is contained in casing 68 whereas Y motor 67 is contained in cover 69. X-direction transfer mechanism 64 and Y-direction transfer mechanism 65 will not be described in detail since they are known components of transfer device 61.

Next, a description will be given in detail on attachment 70 according to a first exemplary embodiment.

Attachment 70, as shown in FIGS. 3, 4, and 6A to 6D includes body 71, connecting element 72, needle 73, and needle vertically moving mechanism 74. Needle vertically moving mechanism 74 includes needle support 75 that supports needle 73, and a link element 76 constituting a transmission mechanism. Body 71 is integrally configured by guard 81, adapter 82, and support section 83. Guard 81 is formed as a plate that surrounds needle 73 to keep user's fingers etc. away from needle 73 moving up and down for user safety. Adapter 82 is attached to presser bar 16. The lower end of presser bar 16 which is relatively closer to attachment 70 is inserted into adapter 82. Attachment 70 is attached to presser bar 16 by fastening presser bar 16 inserted into attachment 82 by screw 84.

Link element 76 comprises a first arm 761, a second arm 762, and a third arm 763. One end of the first arm 761 has connecting element 72 and the remaining other end is connected to the second arm 762. One end of the second arm 762 is connected to the first arm 761 and the remaining other end is connected to the third arm 763. One end of the third arm 763 is connected to the second arm 762 and the remaining other end of the third arm 763 is integrally provided with needle support 75.

The first arm 761 and the second arm 762 rotate relatively about joint 764 to form a link. Similarly, the second arm 762 and the third arm 763 rotate relatively about joint 765 to form a link. Also, the first arm 761 is supported, at a first support portion 85 provided at its lengthwise mid portion, so as to be rotatable relative to support section 83 that extends integrally from guard 81. Similarly, the third arm 763, having needle support 75 provided integrally with it, is supported, at a second support portion 86 provided at its lengthwise mid portion, so as to be rotatable relative to support section 83 that extends integrally from guard 81.

As described earlier, one end of the first arm 761 is provided with connecting element 72 that is connected to needle clamp 43 provided at the lower end of needle bar 15. To elaborate, the end of first arm 761 on which connecting element 72 is provided has a bifurcated insert 7611 on its inner side for insertion of needle clamp 43. Needle clamp 43 is provided integrally with a cylindrical boss 431 that extends rightward to be inserted into insert 7611. Insert 7611 extends along the lengthwise direction of the first arm 761. Thus, even if boss 431 is moved up and down by the up and down movement of needle bar 16, boss 431, being guided by insert 7611 can be relatively moved in the lengthwise direction of the first arm 761.

Figures 6A, 6B, 6C, 6D:
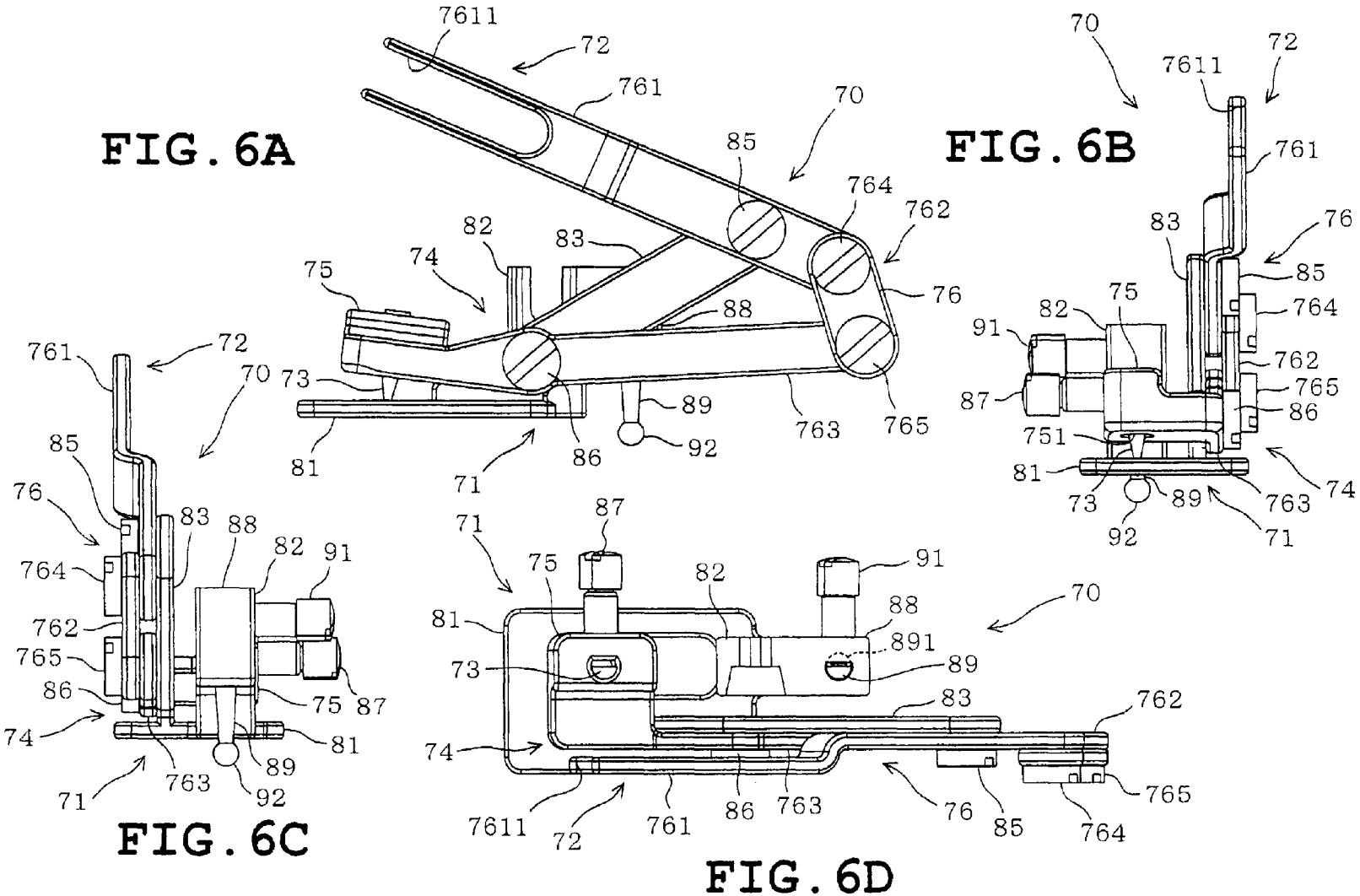
FIG. 6A is a right side view of the workpiece processing attachment according to the first exemplary embodiment.
FIG. 6B is a front side view of the workpiece processing attachment according to the first exemplary embodiment.
FIG. 6C is a rear side view of the workpiece processing attachment according to the first exemplary embodiment.
FIG. 6D is a plan view of the workpiece processing attachment according to the first exemplary embodiment.
Figure 7A:
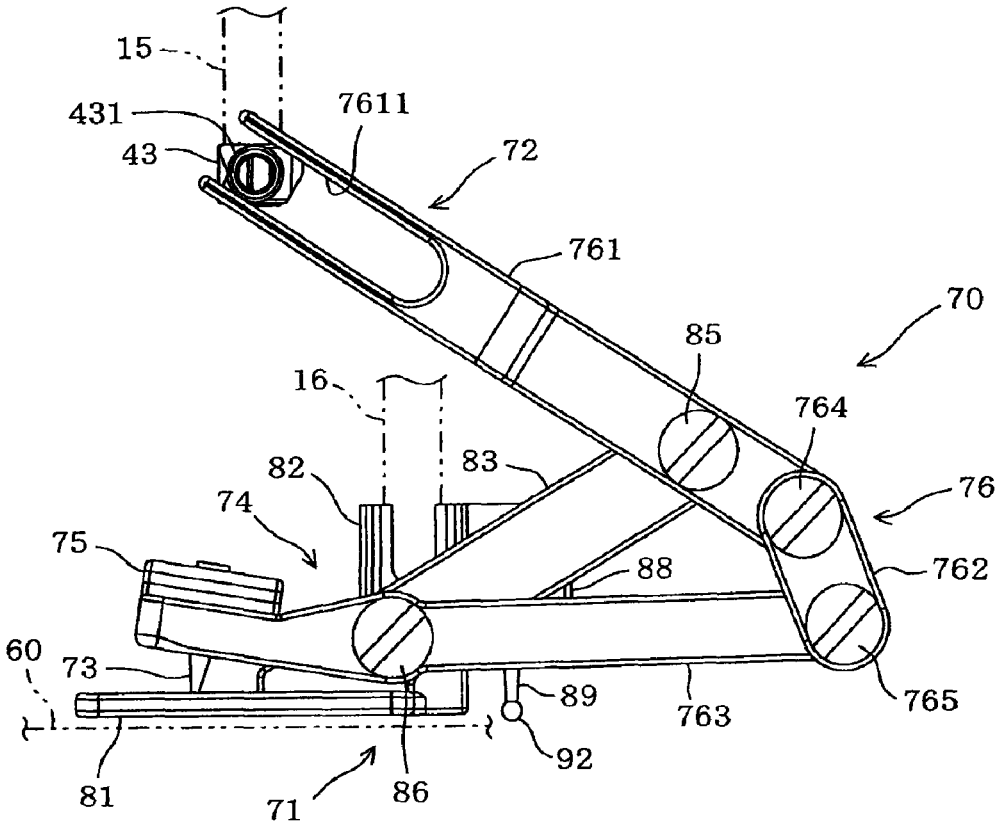
FIG. 7A is a schematic view of the workpiece processing attachment according to the first exemplary embodiment.
Figure 7B:
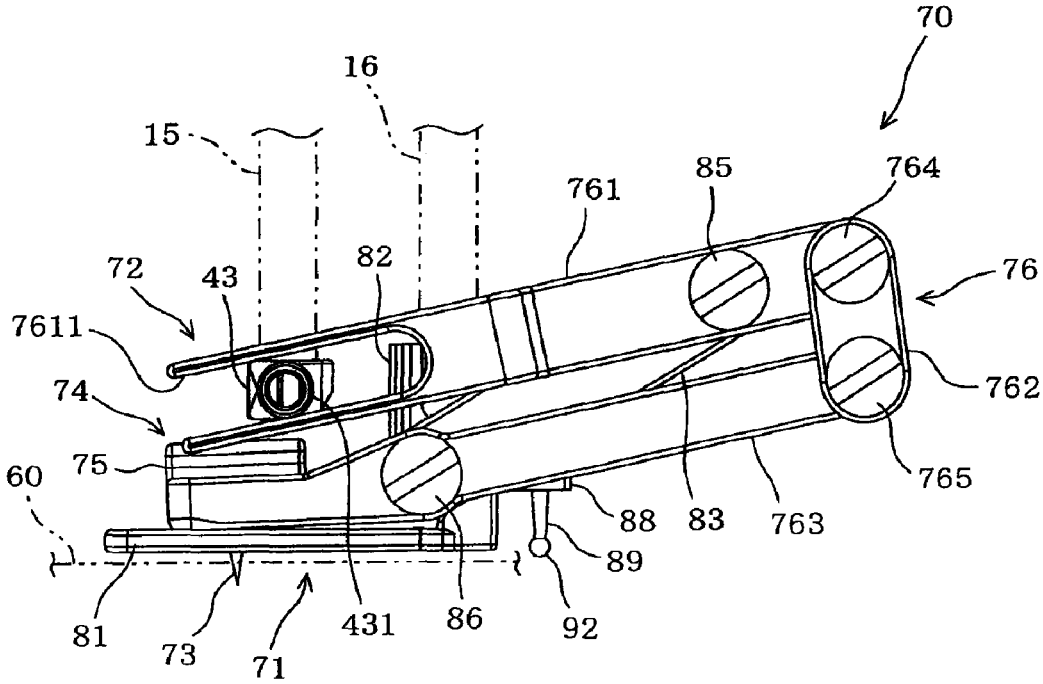
FIG. 7B is a schematic view of the workpiece processing attachment according to the first exemplary embodiment.

Needle support 75 is provided on the front end side of the third arm 763 and swings about a second support portion 86 of support section 83 along with the third arm 763. Needle support 75 supports needle 73. Needle support 75 is provided with needle insert hole 751 for insertion of needle 73 as shown in FIG. 6B. Needle 73 inserted into needle insertion hole 751 is mounted on needle support 75 by being fastened by screw 87. Needle 73 is tapered such that its outer diameter increases toward its axial base end which is supported by needle support 75. Thus, a hole having relatively greater diameter is formed as needle 73 penetrates deeper into workpiece 60, whereas a hole having relatively smaller diameter is formed when the penetration of needle 73 is relatively shallow. As shown in FIGS. 7A and 7B, the tip of needle 73 is located at a position to enter and exit needle hole 44 of needle plate 17.

Body 71 is provided with projection support 88 which is located behind adapter 82. Projection support 88 provides support for projection 89. Projection support 88 has insert hole 891 for insertion of projection 89 as shown in FIG. 6D. Projection 89 inserted into insertion hole 891 is mounted on projection support 88 by fastening screw 91. Projection 89 is bar-shaped having its upper end inserted into projection support 88 and its lower end being provided with pointed tip 92. Pointed tip 92 may be a ball point tip, for instance, as shown in FIG. 6D, or columnar point tip though not shown and may come in various shapes and sizes. By replacing projecting element 89 by loosening/tightening screw 91, the shapes and sizes of pointed tip 92 placed in contact with workpiece 60 may be varied as required.

Next, a description will be given on the operation of attachment 70.

Pulse motor 33, when driven, imparts its drive force to intermediate gear 35 and pinion gear 36 to cause rack 31 to be driven up and down. When rack 31 is elevated, the upper end of rack 31 elevates stop ring 53 secured on the upper end of presser bar 16, consequently elevating attachment 70 attached to presser bar 16. When pulse motor 33 is driven to lower rack 31, press spring 38 placed in contact with the lower end underside of rack 31 is pressed downward. Thus, presser bar clamp 37 secured on presser bar 16 is pressed downward as well to consequently transfer attachment 70 toward needle plate 17. As described above, presser bar 16 having attachment 70 attached to it is driven up and down by pulse motor 33 so as to reciprocate between the upper position and the lower position. The upper position indicates the uppermost end of the reciprocable range of presser bar 16, whereas the lower position indicates the lowermost end of the reciprocable range.

Needle bar 15, on the other hand, is reciprocated up and down between the upper position and the lower position by the drive force of sewing machine motor 30 imparted by needle bar vertically moving mechanism 26. The upper position indicates the uppermost end of the reciprocable range of needle bar 15, whereas the lower position indicates the lowermost end of the reciprocable range.

When needle bar 15 is driven by sewing machine motor 30 with needle bar 16 driven by pulse motor 33 stopped, needle bar 15 becomes relatively displaced from presser bar 16 in its vertical positioning because body 71 of attachment 70 remains stationary and only needle bar 15 is moved up and down. At the lower end of needle bar 15, needle bar clamp 43 is provided which has its boss 431 inserted into insert 7611 of the first arm 431. Thus, when needle bar 15 is moved up and down, the first arm 761 is swung up and down along with the up and down movement of needle bar 15. Because of the earlier described interlinking of the first, second and third arms 761, 762, and 763, the swinging of the first arm 761 caused by the up and down movement of needle bar 15 is transmitted to needle support 75 by way of the second arm 762, and the third arm 763.

As shown in FIG. 7A, when needle bar 15 is in the upper position, the first arm 761, being provided with insert 7611 for insertion of boss 431, is moved upward about the first support portion 85. Thus, the first arm 761, being supported by the first support portion 85, is moved such that the opposite end to which insert 7611 is provided, that is, the second arm 762 side is moved downward. Because the first arm 761 is connected to the second arm 762 at joint 764, the second arm 762 is also moved downward. Likewise, because the second arm 762 is connected to the third arm 763 at joint 765, the third arm 763 being supported by the second support portion 86, is moved such that its second arm 762 side is moved downward along with the second arm 762. As a result, the third arm 763 is moved upward about the second support portion 86 such that the end opposite the end to which the second arm 762 is provided, that is, the needle support 75 side is moved upward about the second support portion 86. Thus, needle 73 supported by needle support 75 is moved above workpiece 60.

When needle bar 15 is moved to the lower position as shown in FIG. 7B, the first arm 761, being provided with insert 7611 for insertion of boss 431, is moved downward about the first support portion 85. Thus, the first arm 761, being supported by the first support portion 85, is moved such that the opposite end to which insert 7611 is provided, that is, the second arm 762 side is moved upward. Because the first arm 761 is connected to the second arm 762 at joint 764, the second arm 762 is also moved upward. Likewise, because the second arm 762 is connected to the third arm 763 at joint 765, the third arm 763 being supported by the second support portion 86, is moved such that its second arm 762 side is moved upward along with the second arm 762. As a result, the third arm 763 is moved downward about the second support portion 86 such that the end opposite the end to which the second arm 762 is provided, that is, the needle support 75 side is moved downward about the second support portion 86. Thus, needle 73 supported by needle support 75 is pierced through workpiece 60.

In the attachment 70 according to the first exemplary embodiment, the ratio in the distance in which needle 73 travels up and down relative to the distance traveled up and down by needle bar 15 can be modified to a given ratio by modifying the position of the first support portion 85, the second support portion 86 and the total length of the second arm 762 as appropriate. The above described configuration allows the distance traveled by the up and down movement of needle bar 15, and consequently needle 73, to be transmitted to needle support 75 in reduced amount. Link element 76, thus, transmits the amount of up and down movement of needle bar 15 to needle support 75 in modified amount (ratio), in this case, in reduced amount. Hence, the amount of up and down movement of needle 73 is less as compared with the up and down movement of needle bar 15.

The diameter of hole formed by the tapered needle 73 varies depending upon the depth of needle 73 pierced through workpiece 60. The depth in which needle 73 is pierced through workpiece 60 varies depending upon the distance between body 71 of attachment 70 and workpiece 60. This means that needle 73 plunges deeper into workpiece 60 as the distance between body 71 and workpiece 60 is relatively smaller, whereas needle 73 plunges shallower into workpiece 60 as the distance between body 71 and workpiece 60 is relatively greater. Thus, the diameter of the hole formed on workpiece 60 by the tapered needle 73 can be controlled by adjusting the position of body 71, in other words, by adjusting the distance between body 71 and workpiece 60 through up and down movement of needle bar 15.

In forming the embosses on workpiece 60 by using projecting element 89, presser bar 16 is driven up and down with needle bar 15 stopped at the upper position, meaning that needle 73 is stopped at the upper position. Attachment 70 is moved up and down with presser bar 16 as presser bar 16 is driven up and down. Thus, projecting element 89 attached to projecting element support 88 is moved up and down with presser bar 16. As a result, embosses are formed on workpiece 60 when projecting element 89 is lowered by the lowering of presser bar 16.

Next, a description will be given on the control system of sewing machine 10.

Sewing machine 10 is provided with controller 100 as shown in FIG. 5. Controller 100 comprises a microcomputer primarily configured by CPU 101, ROM 102, and RAM 103; input interface 104; and output interface 105. Input interface 104 establishes electrical connection with external storage device 106, switches such as sewing start switch 21, potentiometer 41, and limit switch 42. Output interface 105, on the other hand, establishes electrical connection with sewing machine motor 30, pulse motor 33, liquid crystal display 18 hereinafter also described as LCD 18, and X and Y motors 66 and 67 of transfer device 61 by way of corresponding drive circuits 111 to 115. External storage device 106 is configured by nonvolatile memory such as EEPROM and hard disc drive.

ROM 102 stores a control program that controls sewing machine 10. The control program is a collection of programs such as a sewing program for executing a sewing operation, parchment crafting program, and display control program for displaying various information on LCD 18. The control program may also be stored in whole or in part in the external storage device 106 other than ROM 102.

Figure 8:
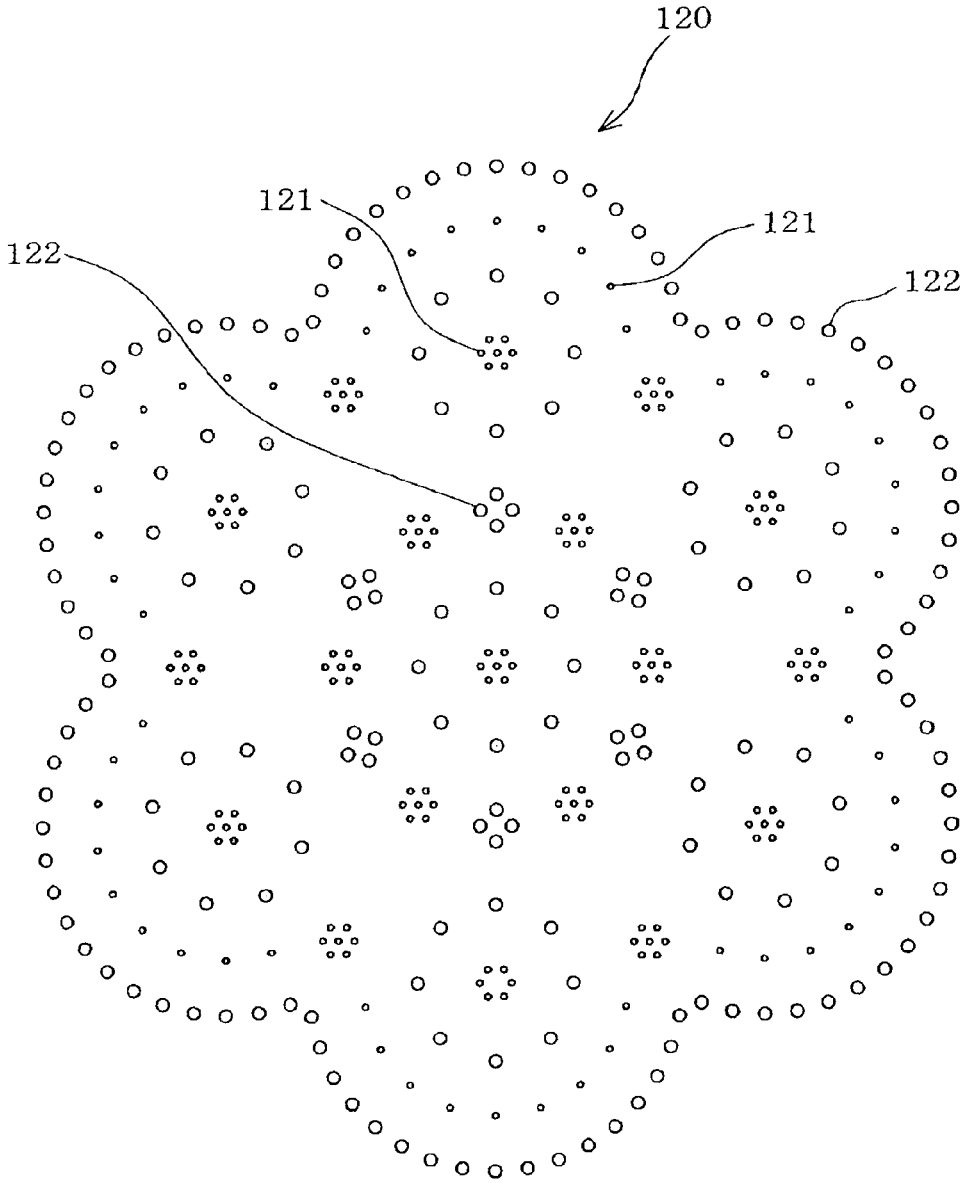
FIG. 8 is a schematic view indicating an exemplary layout of embosses and a holes that constitute a pattern.

Controller 100 controls the drive of various components through execution of the above described programs in forming patterns such as pattern 120 shown in FIG. 8 based on the corresponding pattern data. For instance, needle bar 15, presser bar 16, and frame 62 that supports workpiece 60 are driven by sewing machine motor 30, pulse motor 33, and X and Y motors 66 and 67, respectively according to their relevant programs.

As shown in FIG. 9, pattern data 130 is specified to produce a given pattern such as pattern 120 shown in FIG. 8, and is configured by embossing data 131 and holing data 132. Referring now to FIG. 8, small circles 121 each represent the center of location where emboss is formed by projecting element 89, whereas large circles 122 each represent the center of location where hole is formed by needle 73. As can be seen in FIG. 9, embossing data 131 and holing data 132 constituting pattern data 130 each includes a flag identified as "M value 133" that indicates whether it is embossing data 131 or holing data 132, and coordinates representing where the emboss or the hole is formed which are given in the form of "X-coordinate 134" and "Y-coordinate 135". To elaborate, "0" is set to "M value 133" when the given data is embossing data 131 for forming the emboss and "1" is set when the given data is holing data 132 for forming the hole. For instance, pattern data 120 of the present exemplary embodiment shown in FIG. 9, is represented by a series of embossing data 131 having "0" set to "M value 133" and holing data 132 having "1" set to "M value 133". ROM 102 or external storage 106 not only store pattern data 130 corresponding to pattern 120 shown in FIG. 8 but also multiple pattern data corresponding to multiplicity of other patterns. Thus, the user is allowed, for instance, to select a given pattern from the images of patterns displayed on LCD 18 based on each pattern data.

Embossing data 131 further includes "depth 136" that specifies the depth of emboss, and "depth 136" is specified for each individual emboss. "Depth 136" corresponds to the movement amount of projecting element 89 attached to presser bar 16, that is the movement amount of projecting element 89 attached to attachment 70. When employing tracing paper as workpiece 60, the density or contrast of emboss varies depending on the depth of the emboss formed on the tracing paper. To elaborate, when the movement amount of projecting element 89 is relatively large to form a relatively deep emboss, the emboss shows relatively greater contrast so as to appear increasingly white, whereas when the movement amount of projecting element 89 is relatively small to form a relatively shallow emboss, the emboss shows relatively less contrast so as to appear less white. Thus, by specifying "depth 136" for each individual emboss, the movement amount of projecting element 89 is specified and the depth of emboss formed on workpiece 60 can be controlled.

As one may assume, "depth 136" need not be given by an actual measurement such as "0.5 mm" and "1.2 mm" but may be given in relative scales or levels such as "1" to represent the shallowest emboss, and increased to "2", "3" and so on as depth is increased, and "0" may be specified for "depth 136" if no emboss is to be formed. As described above, controller 100 controls the movement amount of projecting element 89 of attachment 70 attached to presser bar 16 based on the actual measurement of "depth 136" or levels of "depth 136".

Figure 10:
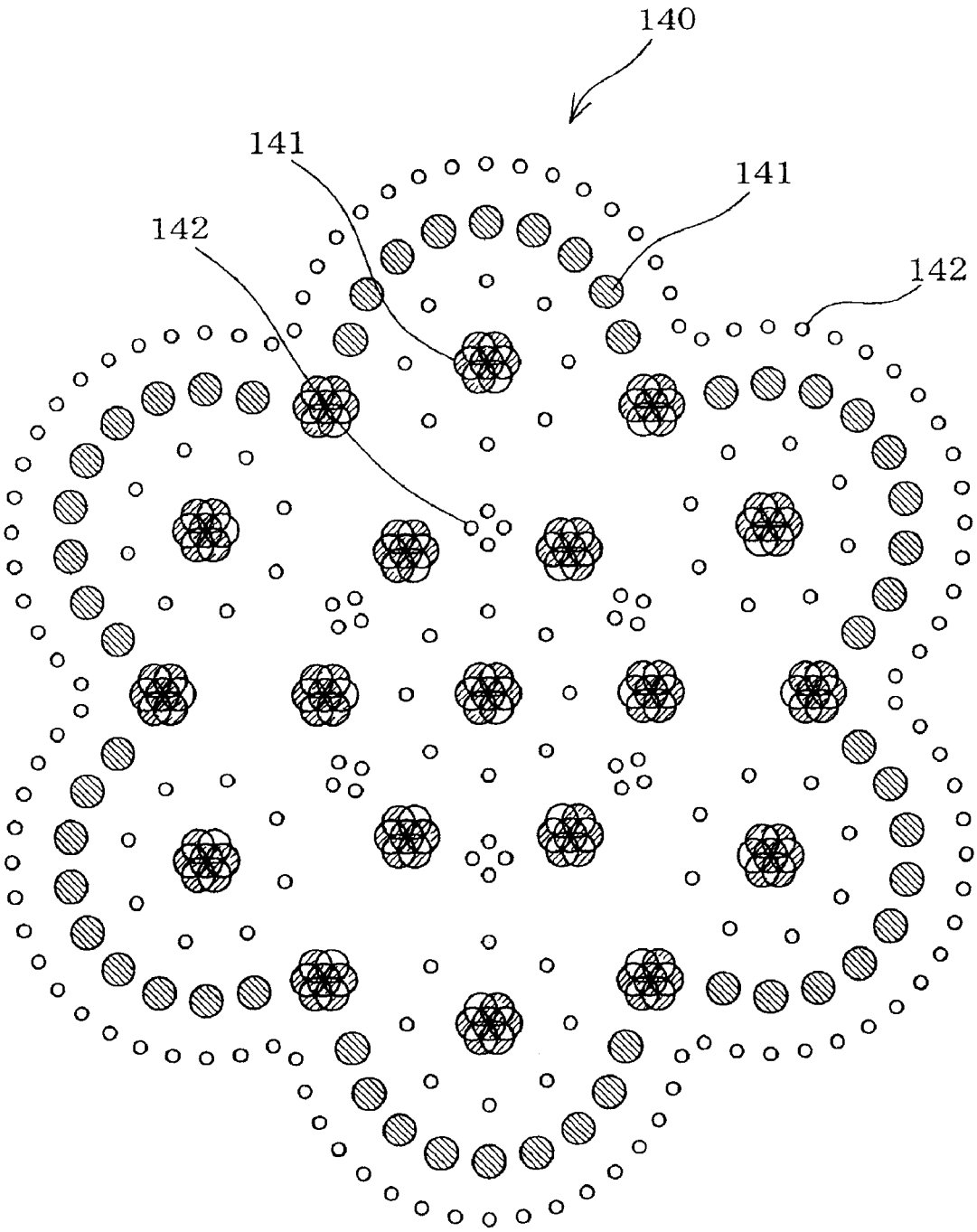
FIG. 10 schematically illustrates embosses and holes that constitute a pattern.
Figure 11:
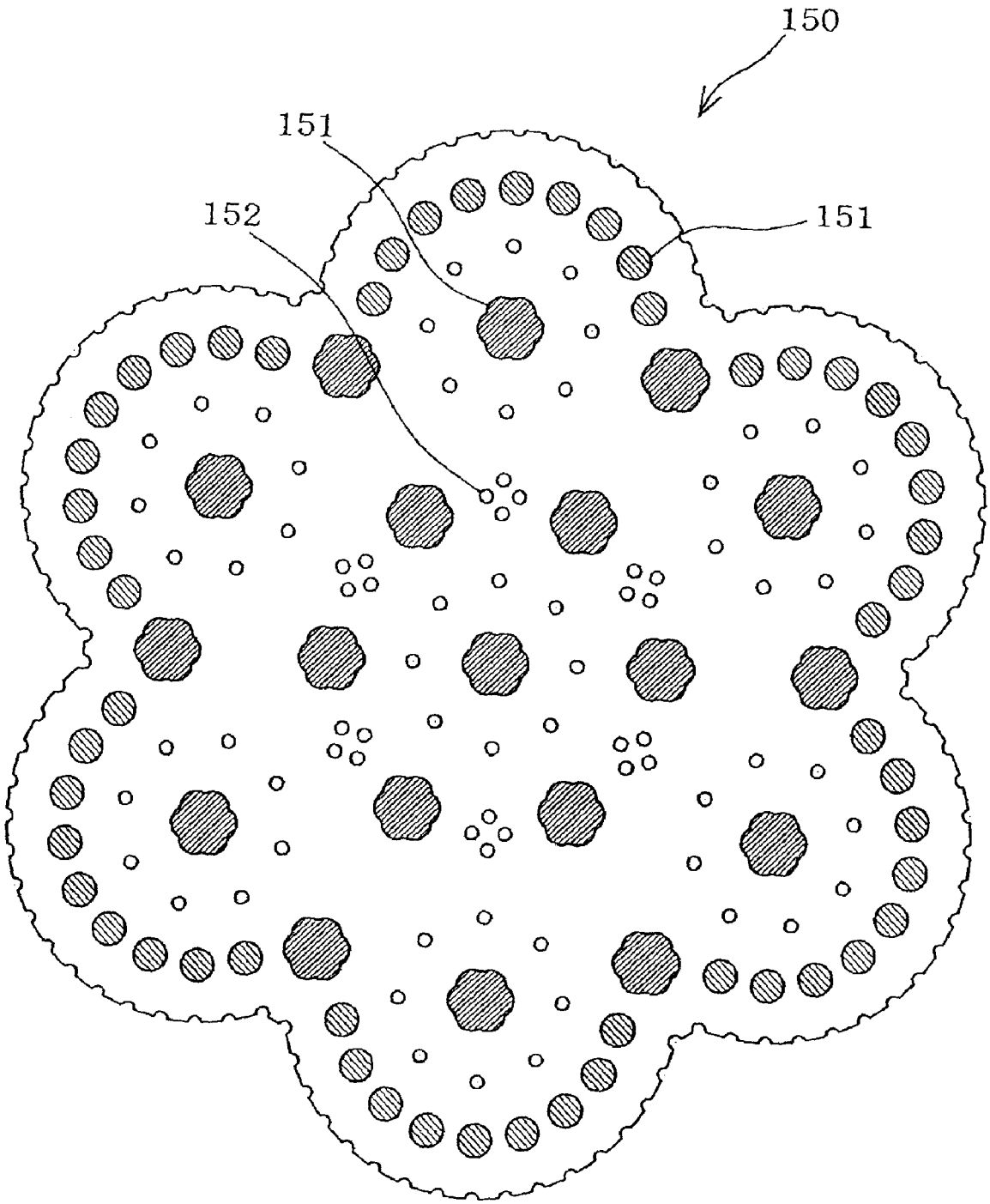
FIG. 11 schematically illustrates a finished product formed by embosses and holes.

X coordinate 134 and Y coordinate 135 of embossing data 131 and holing data 132 indicate the location where the emboss and the hole is formed. Controller 100 drives X motor 66 and Y motor 67 of transfer device 61 based on X coordinate 134 and Y coordinate 135 of pattern data 130. Workpiece 60 supported by frame 62 of transfer unit 61 is thus, transferred to the line of extension extending vertically from the center of projecting element 89 or needle 73 based on X coordinate 134 and Y coordinate 135. As a result, pattern 140 as shown in FIG. 10 made of embosses 141 and holes 142 are formed based on pattern data 130. In pattern 140 shown in FIG. 10, relatively large, shaded circular portion indicates emboss 141, whereas relatively small, circular portion indicates hole 142. Product 150 as such shown in FIG. 11 is created by cutting out workpiece 60 along the outline defined by the outermost holes 142 of pattern 140 made of embosses 141 and holes 142 with instruments such as scissors. In product 150, the shaded portion corresponds to embosses 151 and the inner region of relatively small, circular portion corresponds to holes 152.

Next, a description will be given on the parchment crafting process executed by sewing machine 10 configured as described above.

Figure 12:
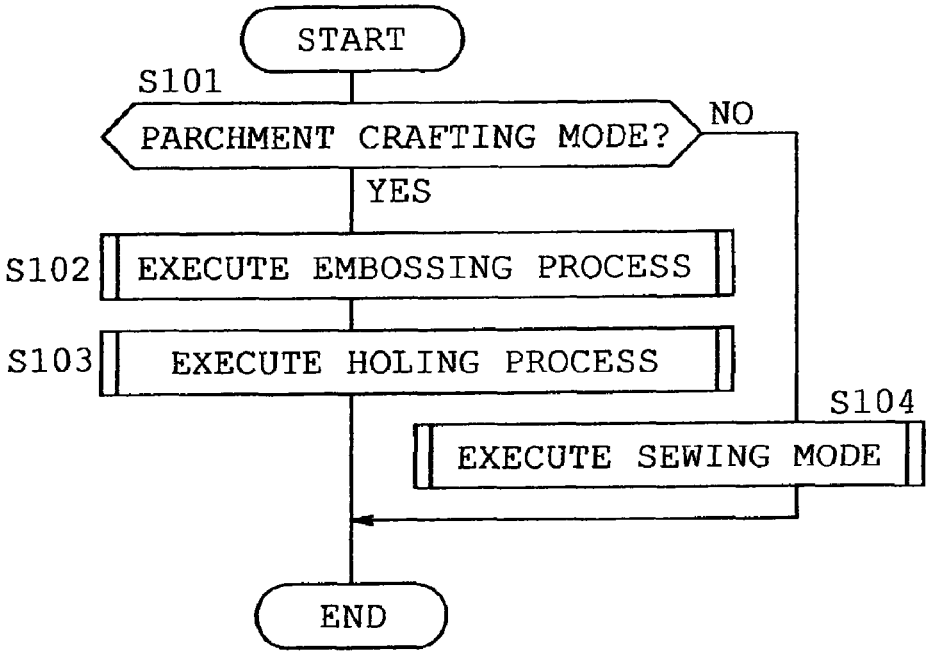
FIG. 12 indicates a process flow of parchment crafting executed by the sewing machine according to the first exemplary embodiment.

First, the main routine of the parchment crafting process executed by sewing machine 10 will be described based on FIG. 12.

As the first step of the process, controller 100 determines whether or not the current process flow is running under the parchment crafting mode in which parchment crafting is executed (S101). As mentioned earlier, sewing machine 10 is capable of executing normal sewing operation in addition to parchment crafting, and thus, controller 100 determines whether the specified mode is a parchment crafting mode or a sewing mode. When in the parchment crafting mode, attachment 70 is attached to needle bar 15 and presser bar 16 by way of adapter 82. Boss 431 of needle clamp 43 is inserted into insert 7611 provided at the first arm 761 of attachment 70.

When in the sewing mode, on the other hand, presser foot not shown is attached to presser bar 16. Further, when in the sewing mode, a thread spool wound with needle thread and bobbin wound with wound with bobbin thread not shown are attached to sewing machine 10. Neither needle thread nor bobbin thread are used when in the parchment crafting mode, and thus, controller 100 ignores the outputs from a needle thread sensor not shown that detects the presence/absence of the needle thread and the outputs from bobbin thread amount sensor not shown that detects the remaining bobbin thread amount. In the present exemplary embodiment, when in the parchment crafting mode, sewing machine 10 has transfer device 61 attached to it, whereas when in the sewing mode, transfer device 61 is detached from sewing machine 10 in executing a normal sewing operation and attached to sewing machine 10 when executing an embroidery sewing operation.

Controller 100, when determining that parchment crafting mode is specified (S101: Yes), executes embossing process (S102) for forming embosses 141 and holing process (S103) for forming holes 142. In the present exemplary embodiment, embossing process and holing process are carried out in separate steps in which embossing process is executed entirely across workpiece whereafter holing process is executed entirely across workpiece 60. Embossing process and holing process will be detailed afterwards. Controller 100, when determining that the sewing mode is set (S101: No), executes either the normal sewing operation or the embroidery sewing operation (S104).

Figure 13:
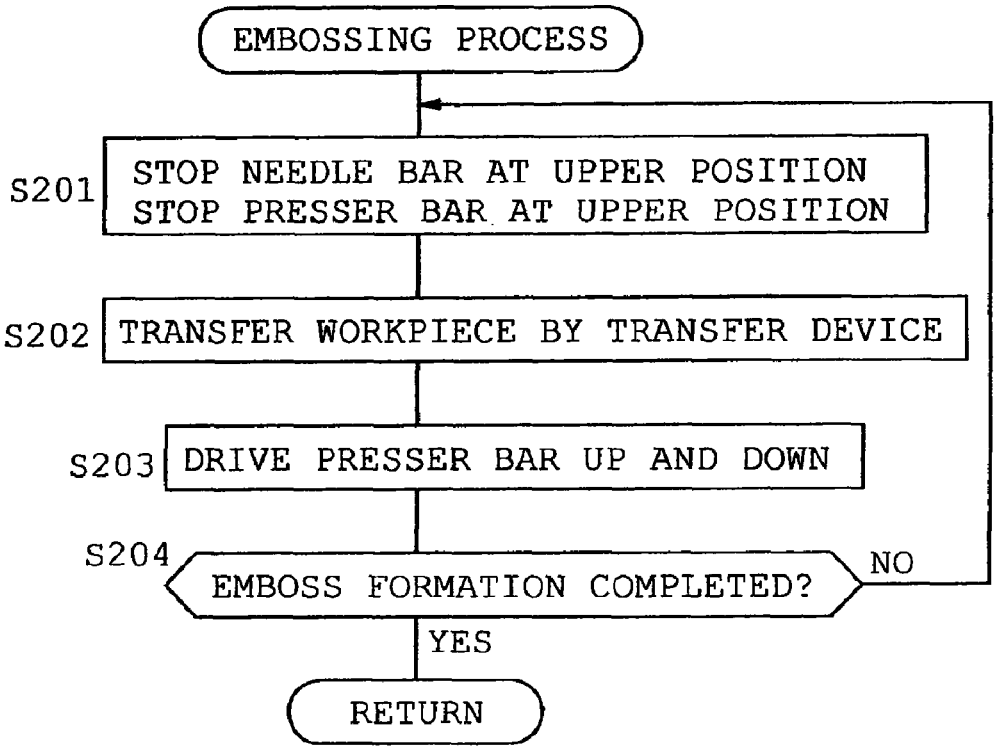
FIG. 13 schematically indicates a process flow of an embossing process.

Next, a description will be given on the embossing process based on FIG. 13.

When proceeding to the embossing process at S102 of the main routine, controller 100 drives needle bar 15, presser bar 16, and transfer device 61. To elaborate, controller 100 stops needle bar 15 and presser bar 16 at the upper position (S201). The upper position of needle bar 15 and presser bar 16 may be modified to a given position besides the upper end, such as the intermediate position within the vertical reciprocable range, as long as needle 73 and projecting element 89 of attachment 70 do not contact workpiece 60.

In addition to stopping needle bar 15 and presser bar 16 at the upper position, controller 100 transfers workpiece 60 supported by frame 62 to the position for execution of embossing process (S202) by transfer device 61. Controller 100 transfers frame 62 based on the embossing data of the pattern data. In the present exemplary embodiment, projecting element 89 is supported at a position behind attachment 70, in other words at a position distanced by a predetermined spacing from the center of needle 73. Thus, the spacing between projecting element 89 and needle 73 is considered as an adjustment value and controller 100 adds or subtracts the adjustment value to/from the embossing data in moving transfer device 61 in the X and Y directions. Alternatively, embossing data 131 may be specified such that each of the X coordinates 134 and Y coordinates 135 reflects such adjustment value.

Controller 100, when driving needle bar 15, presser bar 16 and transfer device 61, energizes pulse motor 33 so that only presser bar 16 is reciprocated between the upper and lower positions (S203). Controller 100 controls the amount of descent of presser bar 16 based on depth 136 contained in pattern data 130. As described above, controller 100 reciprocates only presser bar 16 up and down and controls the amount of downward movement of presser bar 16. As a result, embosses are formed on workpiece 60 by projecting element 89 provided on attachment 70.

When presser bar 16 is driven up and down, controller 100 determines whether or not formation of every emboss 141 has been completed based on embossing data 131 contained in pattern data 130 (S204). Controller 100, when determining that every emboss 141 has been formed (S204: YES), returns the process flow to the main routine. When controller 100, on the other hand, determines that formation of all embosses 141 have not been completed (S204: No), returns the process flow to step S201, and repeats S201 onwards until formation of every emboss 141 corresponding to every embossing data 131 contained in pattern data 130 is completed.

Figure 14:
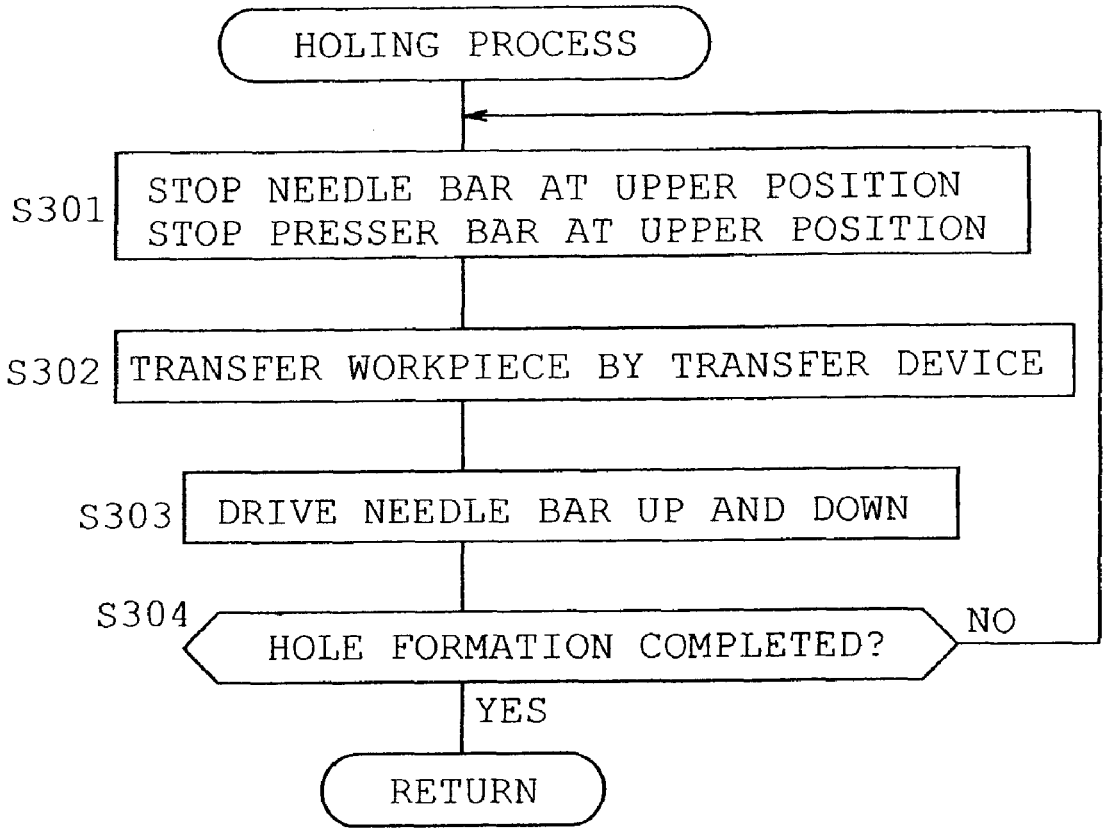
FIG. 14 schematically indicates a process flow of a holing process.

Next, a description will be given on the holing process based on FIG. 14.

When proceeding to the holing process at S103 of the main routine, controller 100 drives needle bar 15, presser bar 16, and transfer device 61. To elaborate, controller 100 stops needle bar 15 and presser bar 16 at the upper position (S301).

In addition to stopping needle bar 15 and presser bar 16 at the upper position, controller 100 transfers workpiece 60 supported by frame 62 to the position for executing the holing process (S302) by transfer device 61. Controller 100 transfers frame 62 based on holing data 132 of pattern data 130. In the present exemplary embodiment, needle 73 is supported by needle bar 15 such that the central axes of needle 73 and needle bar 15 are collinear. Thus, controller 100 drives transfer device 61 in the X and Y directions based on X coordinates 134 and Y coordinates 135 of holing data 132.

Controller 100, when driving needle bar 15, presser bar 16 and transfer device 61, reciprocates needle bar 15 up and down (S303) by energizing sewing machine motor 30 as well as moving presser bar 16 downward to the extent that projecting element 89 attached to attachment 70 does not contact workpiece 60. Needle bar 15 driven by sewing machine motor 30 is vertically reciprocated at a constant pitch as is the case in the normal sewing operation. Vertical movement of needle bar 15 causes insert 7611 of the first arm 761, into which boss 431 of needle clamp 43 mounted on the lower end of needle bar 15 is inserted, to be moved up and down as well. The movement of the first arm 761 caused by the up and down movement of boss 431 is transmitted to needle support 75 by way of the second arm 762 and the third arm 763. At this instance, the up and down movement of needle clamp 43 is transmitted in reduced amount to needle support 75 by the operation of link element 76. Thus, needle support 75 drives needle 73 up and down while rotating about the second support portion 86 to form holes 142 on workpiece 60 by the vertical movement of needle bar 15. The diameter of holes 142 formed on workpiece 60 can be modified by controlling the lowering of presser bar 16 to which attachment 70 is attached.

Once needle bar 15 is driven up and down, controller 100 determines whether or not formation of every hole 142 based on holing data 131 contained in pattern data 130 has been completed (S304). Controller 100, when determining that formation of every hole 142 has been completed (S304: Yes), returns the process flow to the main routine shown in FIG. 12. If controller 100, on the other hand, determines that formation of holes 142 have not been completed (S304: No), returns to step S301 and repeats S302 onwards until formation of every hole 142 corresponding to every holing data 132 contained in pattern data 130 have been completed.

Embosses 141 and holes 142 are formed in sequence on workpiece 60 as shown in FIG. 10 by projecting element 89 reciprocating up and down with presser bar 16, and by needle 73 reciprocating up and down with needle bar 15, respectively according to the above described procedures. Finally product 150 as such shown in FIG. 11 is created by cutting out workpiece 60 along the outline defined by the outermost holes 142 of pattern 140 with instruments such as scissors.

The above described first exemplary embodiment of attachment 70 provides the following effect.

When executing parchment crafting, attachment 70 is attached to needle bar 15 and presser bar 16 of sewing machine 10. Needle 73 of attachment 70 forms holes 142 on workpiece 60 by the up and down movement of needle bar 15. Because holes 142 are formed by attaching attachment 70 on sewing machine 10 and driving needle bar 15, complex patterns made of multiplicity of holes can be formed with ease. Drive force is transmitted to needle 73 from needle bar 15 by way of link element 76. Link element 76 transmits the up and down movement of needle bar 15 to needle 73 in reduced amount. Thus, movement amount of needle bar 15 which travels in relatively large amount is transmitted to needle 73 after being reduced to a level that is enough to allow needle 73 to be pierced through and lifted out of workpiece 60. By reducing the distance of up and down travel of needle 73 and surrounding it with guard 81, user's fingers etc. will not be placed between needle 73 and workpiece 60 at any point in time to provide improved user safety.

Attachment 70 is provided with link element 76 comprising the first arm 761, the second arm 762, the third arm 763, and the first and second support portions 85 and 86. By controlling the length of the first arm 761, the second arm 762, and the third arm 763, or modifying the position of the first support portion 85 or the second support portion 86, the ratio of up and down movement of needle bar 15 to up and down movement of needle 73 can be modified. Thus, drive force can be transmitted from needle bar 15 to needle 73 while reducing the amount of up and down movement of needle 73 under a simple configuration.

The depth in which needle 73 penetrates workpiece 60 varies depending upon the position of attachment 70, that is the distance between the lower end of presser bar 16 and workpiece 60. Needle 73 provided at attachment 70 is tapered such that its outer diameter increases toward its axial base end. Thus, hole 142 having relatively greater diameter is formed as needle 73 penetrates deeper into workpiece 60, whereas a hole having relatively smaller diameter is formed when the penetration of needle 73 is relatively shallow. Thus, by adjusting the distance between attachment 70 and workpiece 60 by needle bar 16, the diameter of hole 142 formed on workpiece 60 can be modified in a simple configuration.

Further, body 71 of attachment 70 is provided with a projecting element 89 that projects downward. Projecting element 89 is moved up and down with body 71 according to the up and down movement of presser bar 16. Thus, by lowering presser bar 16 and pressing projecting element 89 against workpiece 60, emboss 141 is formed on workpiece 60. The above described configuration allows not only holes 142 to be formed on workpiece 60 by needle 73 but also embosses 141 by projecting element 89. Further, by modifying the amount of descent of presser bar 16, the depth of embosses 141 formed on workpiece 60 can be modified, which in turn, allows the density or the contrast of embosses 141 to be modified depending upon the depth of embosses 141 formed on workpiece 60.

Sewing machine 10 provided with the above described attachment 70 provides the following effects.

Sewing machine 10 provided with attachment 70 is further provided with transfer device 61 for transferring workpiece 60. Thus, workpiece 60 is transferred in the X and Y directions by transfer device 61. Such configuration allows coordinated execution of workipece 60 transfer and formation of embosses 141 and holes 142. The mapping of locations to which the workpiece 60 is transferred by transfer device 61 and the locations in which embosses 141 or holes 142 are formed on workpiece 60 by attachment 70 are stored in the form of pattern data 130 to allow embosses 141 and holes 142 to be formed automatically on workpiece 60 in a coordinated manner. This further allows coordinated formation of embosses 141 and holes 142 on workpiece 60 to be executed automatically.

Next, a description will be given on an attachment according to a second exemplary embodiment of the present exemplary embodiment with reference to FIGS. 15 and 16. The elements that are substantially identical to the first exemplary embodiment will be identified with identical reference symbols and will not be described.

Figure 15:
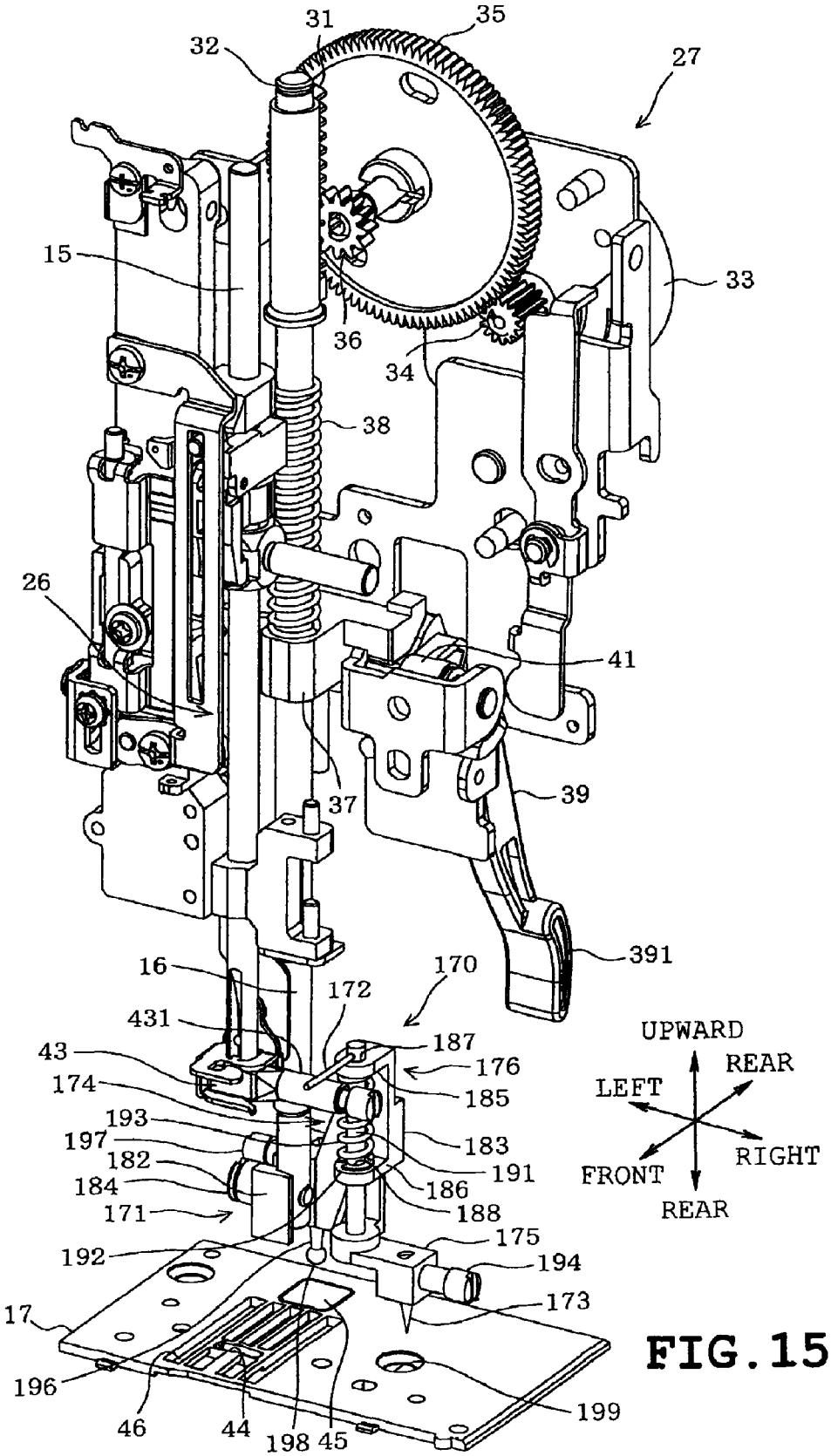
FIG. 15 is a perspective view indicating a needle bar vertically moving mechanism and a presser bar vertically moving mechanism provided within a head of the sewing machine according to a second exemplary embodiment.
Figure 16:
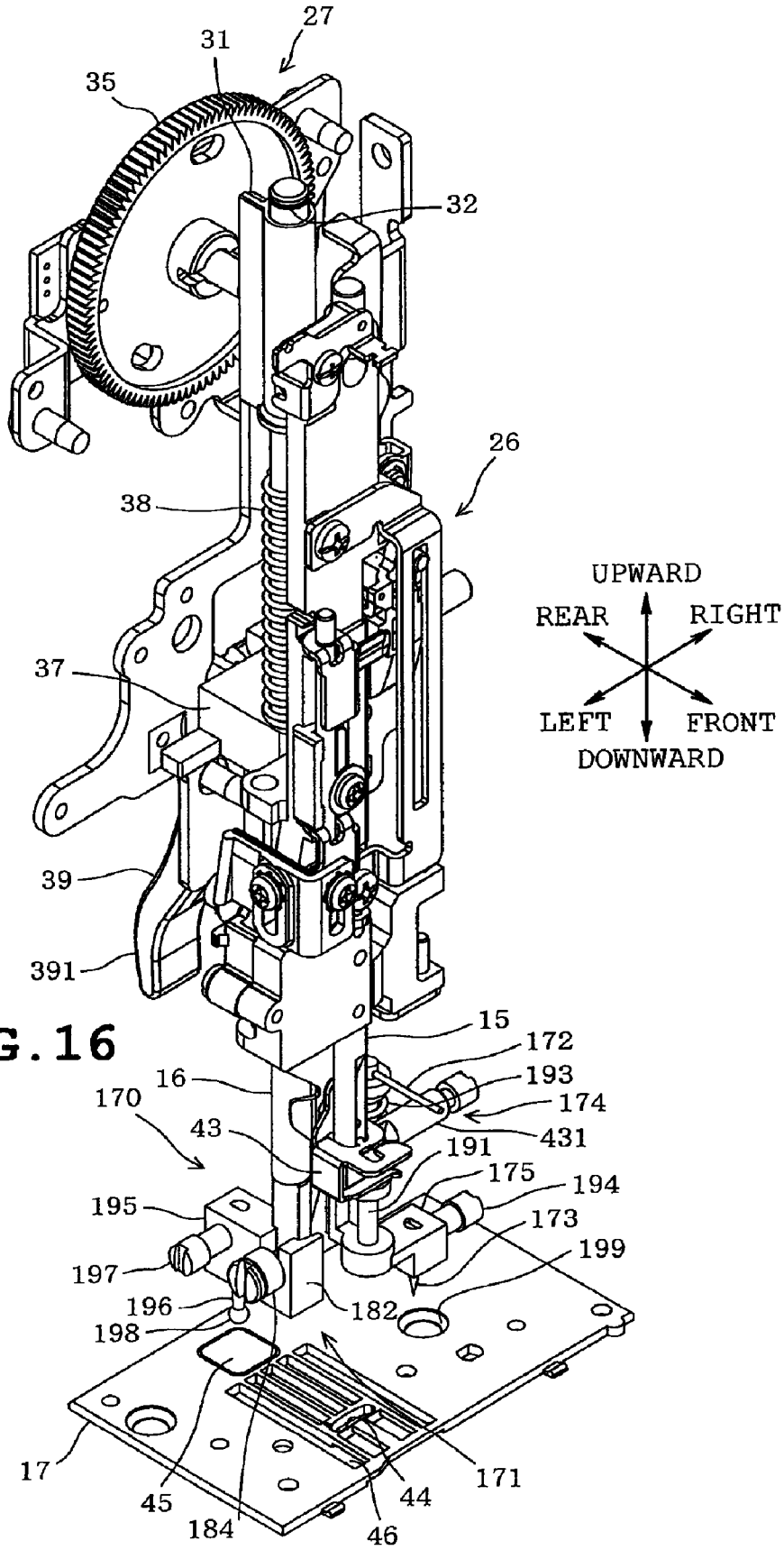
FIG. 16 is a perspective view indicating a needle bar vertically moving mechanism and a presser bar vertically moving mechanism provided within a head of the sewing machine according to a second exemplary embodiment.

Attachment 170 according to the second exemplary embodiment is provided with body 171, connecting element 172, needle 173, and needle vertically moving mechanism 174 as shown in FIGS. 15 and 16. Needle vertically moving mechanism 174 is provided with needle support 175 for supporting needle 173 and transmission mechanism 176. Body 171 is integrally structured by adapter 182 and support section 183. Adapter 182 is attached to presser bar 16 by allowing insertion of the lower end of presser bar 16 where attachment 170 is mounted. Attachment 170 is mounted on presser bar 16 by fastening presser bar 16 inserted into adapter 182 by screw 184. Support section 183 is integrally structured with adapter 182 and is provided with a forwardly extending upper wall 185 and lower wall 186 at its upper and lower ends respectively. Support section 183 has upper hole 187 penetrating upper wall 185 in the up and down direction and lower hole 188 penetrating lower wall 186 in the up and down direction.

Transmission mechanism 176 is provided with shaft 191, stop ring 192, and spring 193. Shaft 191 passes through upper hole 187 of upper wall 185 and lower hole 188 of lower wall 186 so as to be movable up and down relative to support section 183. On the upper axial end of shaft 191, connecting element 172 is provided that extends forward from the upper end proximity of shaft 191. The end of connecting element 172 distal from shaft 191 is placed in contact with boss 431 of needle clamp 43.

Shaft 191 has stop ring 192 secured on its axial mid portion and needle support 175 provided on its lower axial end. Needle support 175 being connected at the lower end of shaft 191 is movable up and down with shaft 191. Shaft 191 is passed through the inner peripheral side of spring 193. The upper end of spring 193 is placed in contact with upper wall 185 whereas the lower end is placed in contact with stop ring 192. Spring 193 exerts pressure to push upper wall 185 and stop ring 192 away from each other, meaning that spring 193 exerts force in the direction to extend itself. Thus, shaft 191 receives consistent downward force from spring 193 and is limited in its downward movement by stop ring 192 contacting lower wall 186.

Needle support 175, as described earlier, is connected to the lower end of shaft 191 and is moved up and down with shaft 191. Needle support 175 supports needle 173. Needle 173 is mounted on needle support 175 by being inserted into needle insert hole not shown provided at needle support 175 and by being fastened by screw 194. Needle 173, as described in the first exemplary embodiment, is tapered such that its outer diameter increases toward its axial base end supported by needle support 175.

Body 171 is provided with projecting element support 195 that supports projecting element 196 behind adapter 182 as shown in FIG. 15. Projecting element 196 is mounted on projecting element support 195 by being inserted into an insert hole not shown provided at projecting element support 196 and by being fastened by screw 197. Thus, projecting element 196 is replacable by unfastening screw 197. Projecting element 196 is bar-shaped as described in the first exemplary embodiment and has pointed tip 198 provided on its extreme end. Needle plate 17 is provided with needle hole 199 that opposes needle 173 on the line of extension of the central line of needle 173. Needle 173 being supported by needle support 175 enters and exits needle hole 199. Further, needle plate 17 is provided with receiving section 45 that opposes projecting element 196 on the line of extension of the central line of projecting element 196.

Next, a description will be given on the operation of attachment 170.

Presser bar 16 is driven up and down between the upper position and the lower position by pulse motor 33 as described in the first exemplary embodiment. Similarly, needle bar 15 is driven up and down by between the upper position and the lower position by sewing machine motor 30 as described in the first exemplary embodiment.

When needle bar 15 is driven by sewing machine motor 30 with needle bar 16 driven by pulse motor 33 stopped, needle bar 15 becomes relatively displaced from presser bar 16 in its vertical positioning because body 171 of attachment 170 remains stationary and only needle bar 15 is moved up and down. At the lower end of needle bar 15, needle bar clamp 43 is provided which has its boss 431 placed in contact with connecting element 172 extending from shaft 191. Thus, when needle bar 15 is moved up and down, shaft 191 being provided with connecting element 172 is moved up and down according to the up and down movement of needle bar 15.

Figure 17A:
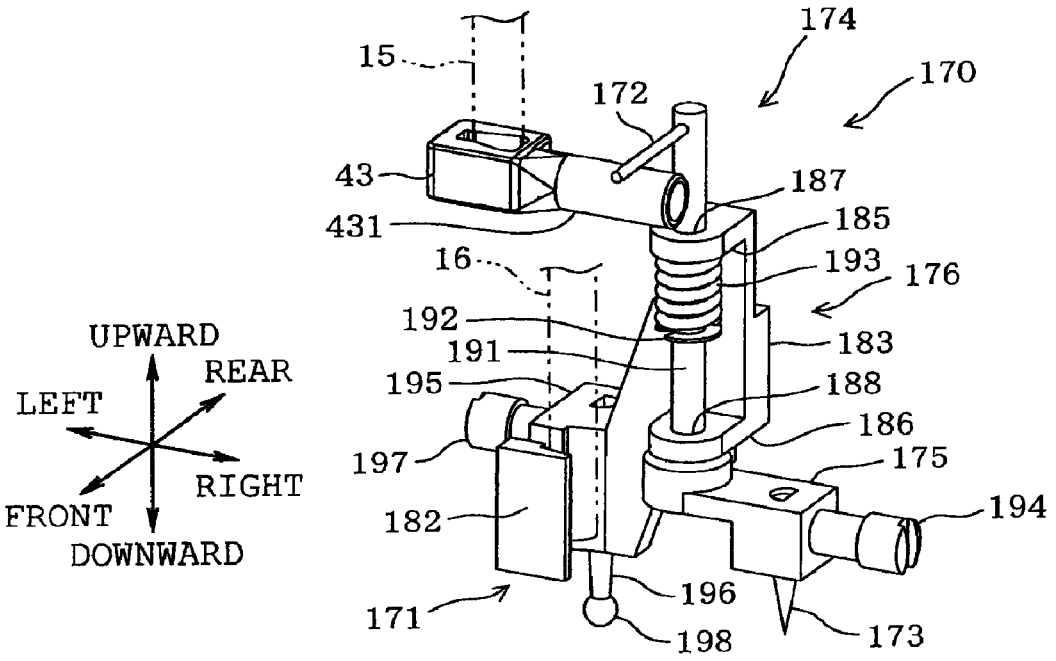
FIG. 17A is a schematic view of the workpiece processing attachment according to the second exemplary embodiment in an elevated state.
Figure 17B:
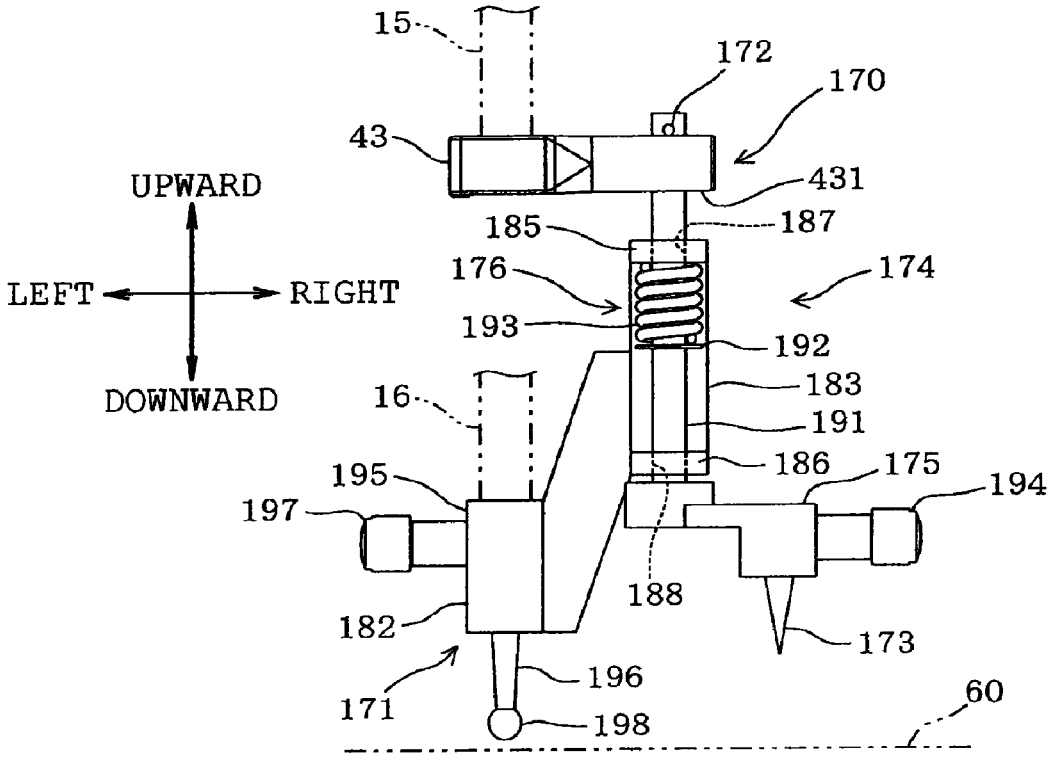
FIG. 17B is a schematic view of the workpiece processing attachment according to the second exemplary embodiment in an elevated state.

When needle bar 15 is in the upper position, connecting element 172 placed in contact with needle clamp 43 provided at the lower end of needle bar 15 is lifted upward by needle bar clamp 43 as shown in FIGS. 17A and 17B. Thus, shaft 191 being provided with connecting element 172 is moved upward integrally with needle support 175 against the pressure exerted by spring 193. As can be understood from the above description, needle 173 is most distant from workpiece 60 when needle 15 is in the upper position.

Figure 18A:
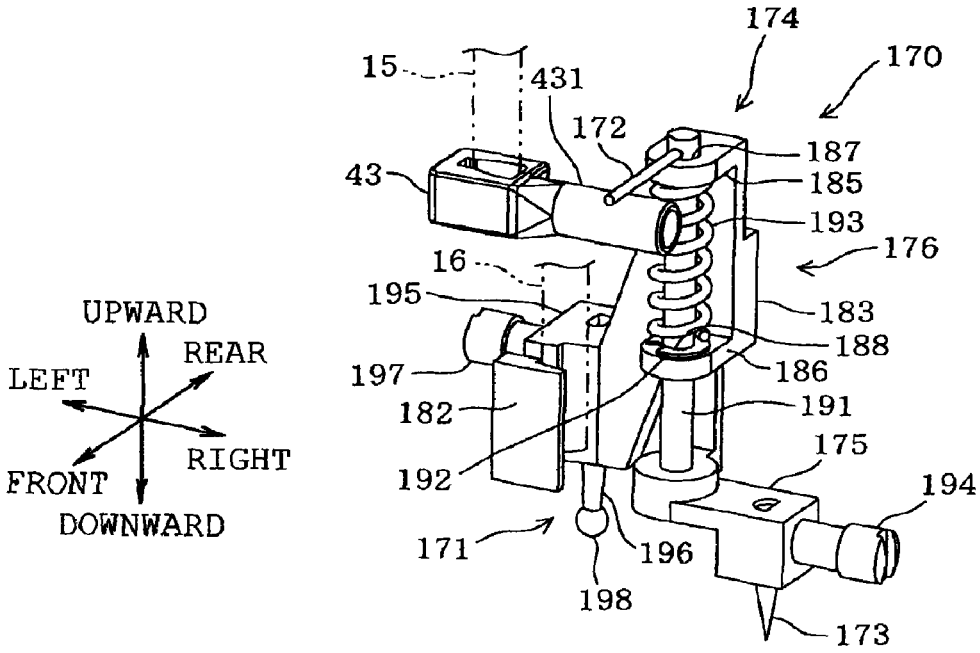
FIG. 18A is a schematic view of the workpiece processing attachment according to the second exemplary embodiment in a lowered state.
Figure 18B:
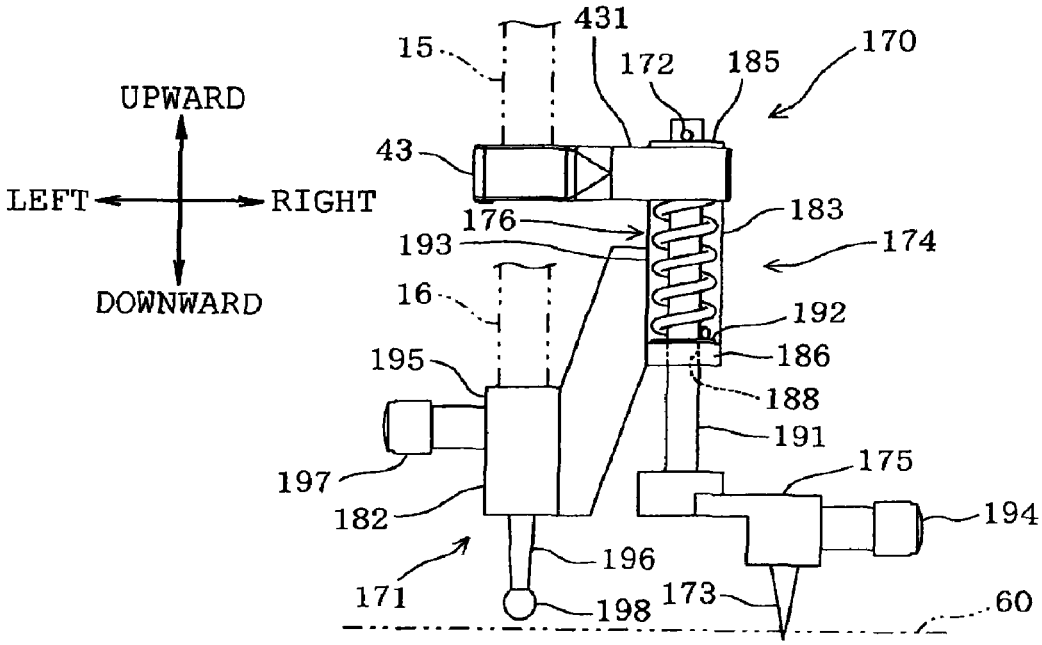
FIG. 18B is another schematic view of the workpiece processing attachment according to the second exemplary embodiment in a lowered state.

When needle bar 15 is lowered, needle clamp 43 provided at the lower end of needle bar 15 is lowered as well. At this instance, shaft 191 provided with connecting element 172 receives downward pressure from spring 193 by way of stop ring 192. Thus, shaft 191 is lowered as needle bar 15 is lowered while maintaining the contact between connecting element 172 and needle clamp 43. Shaft 191 is lowered until stop ring 192 contacts lower wall 186 as shown in FIGS. 18A and 18B. When stop ring 192 contacts lower wall 186, shaft 191 is prevented from further descent. Thus, when needle bar 15 is lowered to a predetermined position from the upper position, needle 173 assumes a position to pierce workpiece 60.

Needle bar 15 is further lowered even after stop ring 192 contacts lower wall 186 until it reaches the lowermost position. While needle bar 15 is being transferred to the lowermost position after stop ring 192 contacts lower wall 186, the contact between needle clamp 43 and connecting element 172 is cancelled. Thus, in the meantime, needle 173 stays pierced through workpiece 60.

Even when needle bar 15 is elevated from the lowered position, needle 173 stays pierced through workpiece 60 until needle clamp 43 and connecting element 172 reestablish contact. When needle bar 15 is further elevated along with needle clamp 43 after needle clamp 43 reestablishes contact with connecting element 172, shaft 191 provided with connecting element 172 is elevated along with needle bar 15 while compressing spring 193. Thus, needle support 175 being mounted on shaft 191 is elevated with shaft 191 to cause needle 173 to be removed from workpiece 60.

As described above, the up and down movement of needle bar 15 is transmitted to needle 173 by way of needle clamp 43, connecting element 172, shaft 191, and needle support 175 to cause needle 173 to be moved up and down with the up and down movement of needle bar 15. According to the second exemplary embodiment, stop ring 192 secured on shaft 191 contacts lower wall 186 and needle bar 15 continues its descent even after the contact between needle clamp 43 and connecting element 172 has been cancelled. Thus, needle 173 is moved up and down only while needle clamp 43 and connecting element 172 are placed in contact. As a result, the amount of up and down movement of needle 173 is less than the up and down movement of needle bar 15.

When forming embosses on workpiece 60 with projecting element 196, presser bar 16 is driven up and down with needle bar 15 stopped at the upper position, in other words, with needle 173 placed in the upper position. The up and down drive of needle bar 16 causes attachment 70 to be moved up and down with needle bar 16. Thus, projecting element 196 mounted on projecting element support 195 is also moved up and down. As a result, projecting element 196 being lowered by presser bar 16 forms embosses on workpiece 60.

The above described attachment 170 according to the second exemplary embodiment also provides effects similar to those provided by the first exemplary embodiment.

As compared with the first exemplary embodiment which transmits drive force through a link element, attachment 170 of the second exemplary embodiment requires less parts and thus, is more simple in structure. Further, by modifying the position of stop ring 192 or the amount of protrusion of needle 173 from needle support 175, the amount of up and down movement of needle 173 can be readily modified. Yet, further, in the second exemplary embodiment, needle 173 does not reside on the line of extension running axially through the center of needle bar 15 unlike the first exemplary embodiment. Thus, when transferring workpiece 60 with transfer device 61, the position of needle 173 relative to needle bar 15 is modified not only when forming embosses with projecting element 196, but also when forming holes with needle 173.

The second exemplary embodiment describes a configuration in which connecting element 172 contacts the upper side of boss 431 of needle clamp 43. However, connecting element 172 may be configured to contact the underside of boss 431. In such case, needle clamp 43 contacts connecting element 172 during the course of descent of needle bar 15 from the upper position to the lower position. Lowering of shaft 191 with connecting element 172 along with the lowering of needle bar 15 causes needle 173 to be pierced through workpiece 60. When needle bar 15 is elevated, on the other hand, connecting element 172 is elevated while maintaining contact with needle clamp 43 by the force exerted by spring 193 to cause needle 173 to be removed from workpiece 60. Of note is that the amount of protrusion of needle 173 remains unchanged because the lower position of needle bar 15 remains unchanged, which means that the diameter of hole formed on workpiece 60 is also unchanged. If it is desired to modify the diameter of the hole, adjustment can be made on the mount position or the vertical positioning of needle 173 relative to needle support 175 by operating screw 194.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A workpiece processing attachment that processes a workpiece and that is detachably attached to a sewing machine including a presser foot that presses the workpiece, a presser bar that has the presser foot detachably attached to a lower end thereof, a presser bar vertically moving mechanism that is configured to move the presser bar up and down, a needle clamp that is configured to detachably receive a sewing needle, a needle bar that has the needle clamp attached to a lower end thereof, and a needle bar vertically moving mechanism that is configured to move the needle bar up and down, the workpiece processing attachment comprising:

a body that is detachably attached to the lower end of the presser bar;

a connecting element that is capable of being connected to the needle clamp and that is movable up and down with the needle bar being moved up and down by the needle bar vertically moving mechanism;

a needle that is configured to penetrate the workpiece to form a hole in the workpiece, the needle being different from the sewing needle; and a needle vertically moving mechanism that is configured to move the needle up and down by the up and down movement of the connecting element.

2. The attachment according to claim 1, wherein the needle vertically moving mechanism further comprises a transmission element that is configured to move the needle up and down so that amount of the up and down movement of the needle is less than amount of the up and down movement of the needle bar.

3. The attachment according to claim 1, wherein a diameter of the needle varies axially to define a taper.

4. The attachment according to claim 1, further comprising a projecting element that is provided at the body and that is configured to press the workpiece to form an emboss, wherein the presser bar vertically moving mechanism moves the projecting element up and down with the up and down movement of the needle bar.

5. A sewing machine comprising:

a presser foot that is configured to press a workpiece;

a presser bar that has the presser foot detachably attached to a lower end thereof;

a presser bar vertically moving mechanism that is configured to move the presser bar up and down;

a needle clamp that is configured to detachably receive a sewing needle;

a needle bar that has the needle clamp attached to a lower end thereof;

a needle bar vertically moving mechanism that is configured to move the presser bar up and down; and a workpiece processing attachment, including:

a body that is detachably attached to the lower end of the presser bar, a connecting element that is capable of being connected to the needle clamp and that is movable up and down with the needle bar being moved up and down by the needle bar vertically moving mechanism, a needle that is configured to penetrate the workpiece to form a hole in the workpiece, a needle vertically moving mechanism that is configured to move the needle up and down by the up and down movement of the connecting element, a transfer device that is configured to transfer the workpiece being held in a front and rear direction defined as a Y direction and a left and right direction defined as an X direction, and a controller that is configured to execute transfer of the workpiece in at least either of the X direction and the Y direction in coordination with formation of the hole on the workpiece by the workpiece processing attachment.

6. The sewing machine according to claim 5, further comprising a storage that is configured to store holing data that provides a mapping between a location of transfer of the workpiece by the transfer device and a location of the hole formed by the workpiece processing attachment.

* * * * *